US009033042B2

(12) United States Patent
Karanikas et al.

(10) Patent No.: US 9,033,042 B2
(45) Date of Patent: May 19, 2015

(54) FORMING BITUMEN BARRIERS IN SUBSURFACE HYDROCARBON FORMATIONS

(75) Inventors: John Michael Karanikas, Houston, TX (US); Gary Lee Beer, Spartanburg, SC (US); Marian Marino, Houston, TX (US); Robert Irving McNeil, III, Cypress, TX (US); Augustinus Wilhelmus Maria Roes, Kuala Lumpur (MY); Robert Charles Ryan, Houston, TX (US); Richard Pollard, Pearland, TX (US)

(73) Assignee: Shell Oil Company, Houston, TX (US)

( * ) Notice: Subject to any disclaimer, the term of this patent is extended or adjusted under 35 U.S.C. 154(b) by 413 days.

(21) Appl. No.: 13/083,289

(22) Filed: Apr. 8, 2011

(65) Prior Publication Data

US 2011/0247814 A1 Oct. 13, 2011

Related U.S. Application Data

(63) Continuation-in-part of application No. PCT/US2011/031559, filed on Apr. 7, 2011.

(60) Provisional application No. 61/322,654, filed on Apr. 9, 2010, provisional application No. 61/322,513, filed on Apr. 9, 2010, provisional application No. 61/391,389, filed on Oct. 8, 2010.

(51) Int. Cl.

| | |
|---|---|
| ***E21B 36/00*** | (2006.01) |
| ***E21B 43/24*** | (2006.01) |
| ***E21B 43/30*** | (2006.01) |

(52) U.S. Cl.

CPC ..... *E21B 36/001* (2013.01); *E21B 43/24* (2013.01); *E21B 43/30* (2013.01)

(58) Field of Classification Search

None

See application file for complete search history.

(56) References Cited

U.S. PATENT DOCUMENTS

| | | | |
|---|---|---|---|
| 48,994 | A | 7/1865 | Parry |
| 94,813 | A | 9/1885 | Dickey |

(Continued)

FOREIGN PATENT DOCUMENTS

| | | |
|---|---|---|
| CA | 1168283 | 5/1984 |
| CA | 1196594 | 11/1985 |

(Continued)

OTHER PUBLICATIONS

Moreno, James B., et al., Sandia National Laboratories, "Methods and Energy Sources for Heating Subsurface Geological Formations, Task 1: Heat Delivery Systems," Nov. 20, 2002, pp. 1-166.

(Continued)

*Primary Examiner* — Angela M DiTrani
*Assistant Examiner* — Anuradha Ahuja

(57) ABSTRACT

Systems and methods used in treating a subsurface formation are described herein. Some embodiments also generally relate to barriers and/or methods to seal barriers. A method used to treat a subsurface formation may include heating a portion of a formation adjacent to a plurality of wellbores to raise a temperature of the formation adjacent to the wellbores above a mobilization temperature of bitumen and below a pyrolysis temperature of hydrocarbons in the formation; and allowing the bitumen to move outwards from the wellbores towards a portion of the formation comprising water cooler than the mobilization temperature of the bitumen so that the bitumen solidifies in the formation to form a barrier.

23 Claims, 7 Drawing Sheets

(56) References Cited

U.S. PATENT DOCUMENTS

| | | | |
|---|---|---|---|
| 326,439 | A | 9/1885 | McEachen |
| 345,586 | A | 7/1886 | Hall |
| 760,304 | A | 5/1904 | Butler |
| 1,269,747 | A | 6/1918 | Rogers |
| 1,342,741 | A | 6/1920 | Day |
| 1,457,479 | A | 6/1923 | Wolcott |
| 1,510,655 | A | 6/1924 | Clark |
| 1,634,236 | A | 6/1927 | Ranney |
| 1,646,599 | A | 10/1927 | Schaefer |
| 1,660,818 | A | 2/1928 | Ranney |
| 1,666,488 | A | 4/1928 | Crawshaw |
| 1,681,523 | A | 8/1928 | Downey et. al. |
| 1,811,560 | A | 6/1931 | Ranney |
| 1,913,395 | A | 6/1933 | Karrick |
| 2,244,255 | A | 6/1941 | Looman |
| 2,244,256 | A | 6/1941 | Looman |
| 2,288,857 | A | 7/1942 | Subkow |
| 2,319,702 | A | 5/1943 | Moon |
| 2,365,591 | A | 12/1944 | Ranney |
| 2,381,256 | A | 8/1945 | Callaway |
| 2,390,770 | A | 12/1945 | Barton et al. |
| 2,423,674 | A | 7/1947 | Agren |
| 2,444,755 | A | 7/1948 | Steffen |
| 2,466,945 | A | 4/1949 | Greene |
| 2,472,445 | A | 6/1949 | Sprong |
| 2,481,051 | A | 9/1949 | Uren |
| 2,484,063 | A | 10/1949 | Ackley |
| 2,497,868 | A | 2/1951 | Dalin |
| 2,548,360 | A | 4/1951 | Germain |
| 2,593,477 | A | 4/1952 | Newman et al. |
| 2,595,979 | A | 5/1952 | Pevere et al. |
| 2,623,596 | A | 12/1952 | Whorton et al. |
| 2,630,306 | A | 3/1953 | Evans |
| 2,630,307 | A | 3/1953 | Martin |
| 2,634,961 | A | 4/1953 | Ljungstrom |
| 2,642,943 | A | 6/1953 | Smith et al. |
| 2,670,802 | A | 3/1954 | Ackley |
| 2,685,930 | A | 8/1954 | Albaugh |
| 2,695,163 | A | 11/1954 | Pearce et al. |
| 2,703,621 | A | 3/1955 | Ford |
| 2,714,930 | A | 8/1955 | Carpenter |
| 2,732,195 | A | 1/1956 | Ljungstrom |
| 2,734,579 | A | 2/1956 | Elkins |
| 2,743,906 | A | 5/1956 | Coyle |
| 2,757,739 | A | 8/1956 | Douglas et al. |
| 2,759,877 | A | 8/1956 | Eron |
| 2,761,663 | A | 9/1956 | Gerdetz |
| 2,771,954 | A | 11/1956 | Jenks et al. |
| 2,777,679 | A | 1/1957 | Ljungstrom |
| 2,780,449 | A | 2/1957 | Fisher et al. |
| 2,780,450 | A | 2/1957 | Ljungstrom |
| 2,786,660 | A | 3/1957 | Alleman |
| 2,789,805 | A | 4/1957 | Ljungstrom |
| 2,793,696 | A | 5/1957 | Morse |
| 2,794,504 | A | 6/1957 | Carpenter |
| 2,799,341 | A | 7/1957 | Maly |
| 2,801,089 | A | 7/1957 | Scott, Jr. |
| 2,801,699 | A | 8/1957 | Sayre, Jr. et al. |
| 2,803,305 | A | 8/1957 | Behning et al. |
| 2,804,149 | A | 8/1957 | Kile |
| 2,819,761 | A | 1/1958 | Popham et al. |
| 2,825,408 | A | 3/1958 | Watson |
| 2,841,375 | A | 7/1958 | Salomonsson |
| 2,857,002 | A | 10/1958 | Pevere et al. |
| 2,647,306 | A | 12/1958 | Stewart et al. |
| 2,862,558 | A | 12/1958 | Dixon |
| 2,889,882 | A | 6/1959 | Schleicher |
| 2,890,754 | A | 6/1959 | Hoffstrom et al. |
| 2,890,755 | A | 6/1959 | Eurenius et al. |
| 2,902,270 | A | 9/1959 | Salomonsson et al. |
| 2,906,337 | A | 9/1959 | Henning |
| 2,906,340 | A | 9/1959 | Herzog |
| 2,914,309 | A | 11/1959 | Salomonsson |
| 2,923,535 | A | 2/1960 | Ljungstrom |
| 2,932,352 | A | 4/1960 | Stegemeier |
| 2,939,689 | A | 6/1960 | Ljungstrom |
| 2,942,223 | A | 6/1960 | Lennox et al. |
| 2,954,826 | A | 10/1960 | Sievers |
| 2,958,519 | A | 11/1960 | Hurley |
| 2,969,226 | A | 1/1961 | Huntington |
| 2,970,826 | A | 2/1961 | Woodruff |
| 2,974,937 | A | 3/1961 | Kiel |
| 2,991,046 | A | 7/1961 | Yahn |
| 2,994,376 | A | 8/1961 | Crawford et al. |
| 2,997,105 | A | 8/1961 | Campion et al. |
| 2,998,457 | A | 8/1961 | Paulsen |
| 3,004,601 | A | 10/1961 | Bodine |
| 3,004,603 | A | 10/1961 | Rogers et al. |
| 3,007,521 | A | 11/1961 | Trantham et al. |
| 3,010,513 | A | 11/1961 | Gerner |
| 3,010,516 | A | 11/1961 | Schleicher |
| 3,016,053 | A | 1/1962 | Medovick |
| 3,017,168 | A | 1/1962 | Carr |
| 3,026,940 | A | 3/1962 | Spitz |
| 3,032,102 | A | 5/1962 | Parker |
| 3,036,632 | A | 5/1962 | Koch et al. |
| 3,044,545 | A | 7/1962 | Tooke |
| 3,048,221 | A | 8/1962 | Tek |
| 3,050,123 | A | 8/1962 | Scott |
| 3,051,235 | A | 8/1962 | Banks |
| 3,057,404 | A | 10/1962 | Berstrom |
| 3,061,009 | A | 10/1962 | Shirley |
| 3,062,282 | A | 11/1962 | Schleicher |
| 3,095,031 | A | 6/1963 | Eurenius et al. |
| 3,097,690 | A | 7/1963 | Terwilliger et al. |
| 3,105,545 | A | 10/1963 | Prats et al. |
| 3,106,244 | A | 10/1963 | Parker |
| 3,110,345 | A | 11/1963 | Reed et al. |
| 3,113,619 | A | 12/1963 | Reichle |
| 3,113,620 | A | 12/1963 | Hemminger |
| 3,113,623 | A | 12/1963 | Krueger |
| 3,114,417 | A | 12/1963 | McCarthy |
| 3,116,792 | A | 1/1964 | Purre |
| 3,120,264 | A | 2/1964 | Barron |
| 3,127,935 | A | 4/1964 | Poettmann et al. |
| 3,127,936 | A | 4/1964 | Eurenius |
| 3,131,763 | A | 5/1964 | Kunetka et al. |
| 3,132,692 | A | 5/1964 | Marx et al. |
| 3,137,347 | A | 6/1964 | Parker |
| 3,138,203 | A | 6/1964 | Weiss et al. |
| 3,139,928 | A | 7/1964 | Broussard |
| 3,142,336 | A | 7/1964 | Doscher |
| 3,149,670 | A | 9/1964 | Grant |
| 3,150,715 | A | 9/1964 | Dietz |
| 3,149,672 | A | 10/1964 | Orkiszewski et al. |
| 3,163,745 | A | 12/1964 | Boston |
| 3,164,207 | A | 1/1965 | Thessen et al. |
| 3,165,154 | A | 1/1965 | Santourian |
| 3,170,842 | A | 2/1965 | Kehler |
| 3,181,613 | A | 5/1965 | Krueger |
| 3,182,721 | A | 5/1965 | Hardy |
| 3,183,675 | A | 5/1965 | Schroeder |
| 3,191,679 | A | 6/1965 | Miller |
| 3,205,942 | A | 9/1965 | Sandberg |
| 3,205,944 | A | 9/1965 | Walton |
| 3,205,946 | A | 9/1965 | Prats et al. |
| 3,207,220 | A | 9/1965 | Williams |
| 3,208,531 | A | 9/1965 | Tamplen |
| 3,209,825 | A | 10/1965 | Alexander et al. |
| 3,221,505 | A | 12/1965 | Goodwin et al. |
| 3,221,811 | A | 12/1965 | Prats |
| 3,233,668 | A | 2/1966 | Hamilton et al. |
| 3,237,689 | A | 3/1966 | Justheim |
| 3,241,611 | A | 3/1966 | Dougan |
| 3,246,695 | A | 4/1966 | Robinson |
| 3,250,327 | A | 5/1966 | Crider |
| 3,267,680 | A | 8/1966 | Schlumberger |
| 3,272,261 | A | 9/1966 | Morse |
| 3,273,640 | A | 9/1966 | Huntington |
| 3,275,076 | A | 9/1966 | Sharp |
| 3,284,281 | A | 11/1966 | Thomas |
| 3,285,335 | A | 11/1966 | Reistle, Jr. |
| 3,288,648 | A | 11/1966 | Jones |
| 3,294,167 | A | 12/1966 | Vogel |

(56) References Cited

U.S. PATENT DOCUMENTS

| | | | |
|---|---|---|---|
| 3,302,707 | A | 2/1967 | Slusser |
| 3,303,883 | A | 2/1967 | Slusser |
| 3,310,109 | A | 3/1967 | Marx et al. |
| 2,787,325 | A | 4/1967 | Holbrook |
| 3,316,344 | A | 4/1967 | Kidd et al. |
| 3,316,962 | A | 5/1967 | Lange |
| 3,332,480 | A | 7/1967 | Parrish |
| 3,338,306 | A | 8/1967 | Cook |
| 3,342,258 | A | 9/1967 | Prats |
| 3,342,267 | A | 9/1967 | Cotter et al. |
| 3,346,044 | A | 10/1967 | Slusser |
| 3,349,845 | A | 10/1967 | Holbert et al. |
| 3,352,355 | A | 11/1967 | Putman |
| 3,354,654 | A | 11/1967 | Vignovich |
| 3,358,756 | A | 12/1967 | Vogel |
| 3,372,754 | A | 3/1968 | McDonald |
| 3,379,248 | A | 4/1968 | Strange |
| 3,380,913 | A | 4/1968 | Henderson |
| 3,386,508 | A | 6/1968 | Bielstein et al. |
| 3,389,975 | A | 6/1968 | Van Nostrand |
| 3,399,623 | A | 9/1968 | Creed |
| 3,410,796 | A | 11/1968 | Hull |
| 3,410,977 | A | 11/1968 | Ando |
| 3,477,058 | A | 11/1968 | Vedder et al. |
| 3,434,541 | A | 3/1969 | Cook et al. |
| 3,455,383 | A | 7/1969 | Prats et al. |
| 3,465,819 | A | 9/1969 | Dixon |
| 3,474,863 | A | 10/1969 | Deans et al. |
| 3,480,082 | A | 10/1969 | Gilliland |
| 3,485,300 | A | 12/1969 | Engle |
| 3,492,463 | A | 1/1970 | Wringer et al. |
| 3,501,201 | A | 3/1970 | Closmann et al. |
| 3,502,372 | A | 3/1970 | Prats |
| 3,529,682 | A | 3/1970 | Coyne et al. |
| 3,513,913 | A | 5/1970 | Bruist |
| 3,515,837 | A | 6/1970 | Ando |
| 3,526,095 | A | 9/1970 | Peck |
| 3,528,501 | A | 9/1970 | Parker |
| 3,537,528 | A | 11/1970 | Herce et al. |
| 3,542,131 | A | 11/1970 | Walton et al. |
| 3,547,192 | A | 12/1970 | Claridge et al. |
| 3,547,193 | A | 12/1970 | Gill |
| 3,554,285 | A | 1/1971 | Meldau |
| 3,562,401 | A | 2/1971 | Long |
| 3,565,171 | A | 2/1971 | Closmann |
| 3,578,080 | A | 5/1971 | Closmann |
| 3,580,987 | A | 5/1971 | Priaroggia |
| 3,593,789 | A | 7/1971 | Prats |
| 3,595,082 | A | 7/1971 | Miller et al. |
| 3,599,714 | A | 8/1971 | Messman et al. |
| 3,605,890 | A | 9/1971 | Holm |
| 3,614,986 | A | 10/1971 | Gill |
| 3,617,471 | A | 11/1971 | Schlinger et al. |
| 3,618,663 | A | 11/1971 | Needham |
| 3,629,551 | A | 12/1971 | Ando |
| 3,661,423 | A | 5/1972 | Garret |
| 3,675,715 | A | 7/1972 | Speller, Jr. |
| 3,679,812 | A | 7/1972 | Owens |
| 3,680,633 | A | 8/1972 | Bennett |
| 3,700,280 | A | 10/1972 | Papadopoulos et al. |
| 3,757,860 | A | 9/1973 | Pritchett |
| 3,759,328 | A | 9/1973 | Ueber et al. |
| 3,759,574 | A | 9/1973 | Beard |
| 3,761,599 | A | 9/1973 | Beatty |
| 3,766,982 | A | 10/1973 | Justheim |
| 3,770,398 | A | 11/1973 | Abraham et al. |
| 3,779,602 | A | 12/1973 | Beard et al. |
| 3,794,113 | A | 2/1974 | Strange et al. |
| 3,794,116 | A | 2/1974 | Higgins |
| 3,804,169 | A | 4/1974 | Closmann |
| 3,804,172 | A | 4/1974 | Closmann et al. |
| 3,809,159 | A | 5/1974 | Young et al. |
| 3,812,913 | A | 5/1974 | Hardy et al. |
| 3,853,185 | A | 12/1974 | Dahl et al. |
| 3,881,551 | A | 5/1975 | Terry et al. |
| 3,882,941 | A | 5/1975 | Pelofsky |
| 3,892,270 | A | 7/1975 | Lindquist |
| 3,893,918 | A | 7/1975 | Favret, Jr. |
| 3,894,769 | A | 7/1975 | Tham et al. |
| 3,907,045 | A | 9/1975 | Dahl et al. |
| 3,922,148 | A | 11/1975 | Child |
| 3,924,680 | A | 12/1975 | Terry |
| 3,933,447 | A | 1/1976 | Pasini, III et al. |
| 3,941,421 | A | 3/1976 | Burton, III et al. |
| 3,943,160 | A | 3/1976 | Farmer, III et al. |
| 3,946,812 | A | 3/1976 | Gale et al. |
| 3,947,683 | A | 3/1976 | Schultz et al. |
| 3,948,319 | A | 4/1976 | Pritchett |
| 3,948,755 | A | 4/1976 | McCollum et al. |
| 3,950,029 | A | 4/1976 | Timmins |
| 3,952,802 | A | 4/1976 | Terry |
| 3,954,140 | A | 5/1976 | Hendrick |
| 3,958,636 | A | 5/1976 | Perkins |
| 3,972,372 | A | 8/1976 | Fisher et al. |
| 3,973,628 | A | 8/1976 | Colgate |
| 3,986,349 | A | 10/1976 | Egan |
| 3,986,556 | A | 10/1976 | Haynes |
| 3,986,557 | A | 10/1976 | Striegler et al. |
| 3,987,851 | A | 10/1976 | Tham |
| 3,992,474 | A | 11/1976 | Sobel |
| 3,993,132 | A | 11/1976 | Cram |
| 3,994,340 | A | 11/1976 | Anderson et al. |
| 3,994,341 | A | 11/1976 | Anderson et al. |
| 3,999,607 | A | 12/1976 | Pennington et al. |
| 4,005,752 | A | 2/1977 | Cha |
| 4,006,778 | A | 2/1977 | Redford et al. |
| 4,008,762 | A | 2/1977 | Fisher et al. |
| 4,010,800 | A | 3/1977 | Terry |
| 4,014,575 | A | 3/1977 | French et al. |
| 4,016,239 | A | 4/1977 | Fenton |
| 4,018,280 | A | 4/1977 | Daviduk et al. |
| 4,019,575 | A | 4/1977 | Pisio et al. |
| 4,026,357 | A | 5/1977 | Redford |
| 4,029,360 | A | 6/1977 | French |
| 4,031,956 | A | 6/1977 | Terry |
| 4,037,655 | A | 7/1977 | Carpenter |
| 4,037,658 | A | 7/1977 | Anderson |
| 4,042,026 | A | 8/1977 | Pusch et al. |
| 4,043,393 | A | 8/1977 | Fisher et al. |
| 4,048,637 | A | 9/1977 | Jacomini |
| 4,049,053 | A | 9/1977 | Fisher et al. |
| 4,057,293 | A | 11/1977 | Garrett |
| 4,059,308 | A | 11/1977 | Pearson et al. |
| 4,064,943 | A | 12/1977 | Cavin |
| 4,065,183 | A | 12/1977 | Hill et al. |
| 4,067,390 | A | 1/1978 | Camacho et al. |
| 4,069,868 | A | 1/1978 | Terry |
| 4,076,761 | A | 2/1978 | Chang et al. |
| 4,077,471 | A | 3/1978 | Shupe et al. |
| 4,083,604 | A | 4/1978 | Bohn et al. |
| 4,084,637 | A | 4/1978 | Todd |
| 4,085,803 | A | 4/1978 | Butler |
| 4,087,130 | A | 5/1978 | Garrett |
| 4,089,372 | A | 5/1978 | Terry |
| 4,089,373 | A | 5/1978 | Reynolds et al. |
| 4,089,374 | A | 5/1978 | Terry |
| 4,091,869 | A | 5/1978 | Hoyer |
| 4,093,025 | A | 6/1978 | Terry |
| 4,093,026 | A | 6/1978 | Ridley |
| 4,096,163 | A | 6/1978 | Chang et al. |
| 4,099,567 | A | 7/1978 | Terry |
| 4,114,688 | A | 9/1978 | Terry |
| 4,119,349 | A | 10/1978 | Albulescu et al. |
| 4,125,159 | A | 11/1978 | Vann |
| 4,130,575 | A | 12/1978 | Jorn et al. |
| 4,133,825 | A | 1/1979 | Stroud et al. |
| 4,138,442 | A | 2/1979 | Chang et al. |
| 4,140,180 | A | 2/1979 | Bridges et al. |
| 4,140,181 | A | 2/1979 | Ridley et al. |
| 4,144,935 | A | 3/1979 | Bridges et al. |
| 4,148,359 | A | 4/1979 | Laumbach et al. |
| 4,151,068 | A | 4/1979 | McCollum et al. |
| 4,151,877 | A | 5/1979 | French |
| RE30,019 | E | 6/1979 | Lindquist |

(56) References Cited

U.S. PATENT DOCUMENTS 4,158,467 A 6/1979 Larson et al.
4,162,707 A 7/1979 Yan
4,169,506 A 10/1979 Berry
4,183,405 A 1/1980 Magnie
4,184,548 A 1/1980 Ginsburgh et al.
4,185,692 A 1/1980 Terry
4,186,801 A 2/1980 Madgavkar et al.
4,193,451 A 3/1980 Dauphine
4,194,562 A 3/1980 Bousaid et al.
4,197,911 A 4/1980 Anada
4,199,024 A 4/1980 Rose et al.
4,199,025 A 4/1980 Carpenter
4,216,079 A 8/1980 Newcombe
4,228,853 A 10/1980 Harvey et al.
4,228,854 A 10/1980 Sacuta
4,234,230 A 11/1980 Weichman
4,243,101 A 1/1981 Grupping
4,243,511 A 1/1981 Allred
4,248,306 A 2/1981 Van Huisen et al.
4,250,230 A 2/1981 Terry
4,250,962 A 2/1981 Madgavkar et al.
4,252,191 A 2/1981 Pusch et al.
4,256,945 A 3/1981 Carter et al.
4,258,955 A 3/1981 Habib, Jr.
4,260,192 A 4/1981 Shafer
4,265,307 A 5/1981 Elkins
4,273,188 A 6/1981 Vogel et al.
4,274,487 A 6/1981 Hollingsworth et al.
4,277,416 A 7/1981 Grant
4,282,587 A 8/1981 Silverman
4,285,547 A 8/1981 Weichman
RE30,738 E 9/1981 Bridges et al.
4,299,086 A 11/1981 Madgavkar et al.
4,299,285 A 11/1981 Tsai et al.
4,303,126 A 12/1981 Blevins
4,305,463 A 12/1981 Zakiewicz
4,306,621 A 12/1981 Boyd et al.
4,324,292 A 4/1982 Jacobs et al.
4,333,764 A 6/1982 Richardson
4,344,483 A 8/1982 Fisher et al.
4,353,418 A 10/1982 Hoekstra et al.
4,359,687 A 11/1982 Vinegar et al.
4,363,361 A 12/1982 Madgavkar et al.
4,366,668 A 1/1983 Madgavkar et al.
4,366,864 A 1/1983 Gibson et al.
4,378,048 A 3/1983 Madgavkar et al.
4,380,930 A 4/1983 Podhrasky et al.
4,381,641 A 5/1983 Madgavkar et al.
4,382,469 A 5/1983 Bell et al.
4,384,613 A 5/1983 Owen et al.
4,384,614 A 5/1983 Justheim
4,385,661 A 5/1983 Fox
4,390,067 A 6/1983 Wilman
4,390,973 A 6/1983 Rietsch
4,396,062 A 8/1983 Iskander
4,397,732 A 8/1983 Hoover et al.
4,398,151 A 8/1983 Vinegar et al.
4,399,866 A 8/1983 Dearth
4,401,099 A 8/1983 Collier
4,401,162 A 8/1983 Osborne
4,401,163 A 8/1983 Elkins
4,407,973 A 10/1983 van Dijk et al.
4,409,090 A 10/1983 Hanson et al.
4,410,042 A 10/1983 Shu
4,412,124 A 10/1983 Kobayashi
4,412,585 A 11/1983 Bouck
4,415,034 A 11/1983 Bouck
4,417,782 A 11/1983 Clarke et al.
4,418,752 A 12/1983 Boyer et al.
4,423,311 A 12/1983 Varney, Sr.
4,425,967 A 1/1984 Hoekstra
4,428,700 A 1/1984 Lennemann
4,429,745 A 2/1984 Cook
4,437,519 A 3/1984 Cha et al.
4,439,307 A 3/1984 Jaquay et al.
4,440,224 A 4/1984 Kreinin et al.
4,442,896 A 4/1984 Reale et al.
4,444,255 A 4/1984 Geoffrey et al.
4,444,258 A 4/1984 Kalmar
4,445,574 A 5/1984 Vann
4,446,917 A 5/1984 Todd
4,448,251 A 5/1984 Stine
4,449,594 A 5/1984 Sparks
4,452,491 A 6/1984 Seglin et al.
4,455,215 A 6/1984 Jarrott et al.
4,456,065 A 6/1984 Heim et al.
4,457,365 A 7/1984 Kasevich et al.
4,457,374 A 7/1984 Hoekstra et al.
4,458,757 A 7/1984 Bock et al.
4,458,767 A 7/1984 Hoehn, Jr.
4,460,044 A 7/1984 Porter
4,463,988 A 8/1984 Bouck et al.
4,474,236 A 10/1984 Kellett
4,474,238 A 10/1984 Gentry et al.
4,479,541 A 10/1984 Wang
4,485,868 A 12/1984 Sresty et al.
4,485,869 A 12/1984 Sresty et al.
4,487,257 A 12/1984 Dauphine
4,489,782 A 12/1984 Perkins
4,491,179 A 1/1985 Pirson et al.
4,498,531 A 2/1985 Vrolyk
4,498,535 A 2/1985 Bridges
4,499,209 A 2/1985 Hoek et al.
4,501,326 A 2/1985 Edmunds
4,501,445 A 2/1985 Gregoli
4,513,816 A 4/1985 Hubert
4,518,548 A 5/1985 Yarbrough
4,524,826 A 6/1985 Savage
4,524,827 A 6/1985 Bridges et al.
4,530,401 A 7/1985 Hartman et al.
4,537,252 A 8/1985 Puri
4,538,682 A 9/1985 McManus et al.
4,540,882 A 9/1985 Vinegar et al.
4,542,648 A 9/1985 Vinegar et al.
4,544,478 A 10/1985 Kelley
4,545,435 A 10/1985 Bridges et al.
4,549,396 A 10/1985 Garwood et al.
4,552,214 A 11/1985 Forgac et al.
4,570,715 A 2/1986 Van Meurs et al.
4,571,491 A 2/1986 Vinegar et al.
4,572,299 A 2/1986 Van Egmond et al.
4,573,530 A 3/1986 Audeh et al.
4,576,231 A 3/1986 Dowling et al.
4,577,503 A 3/1986 Imaino et al.
4,577,690 A 3/1986 Medlin
4,577,691 A 3/1986 Huang et al.
4,583,046 A 4/1986 Vinegar et al.
4,583,242 A 4/1986 Vinegar et al.
4,585,066 A 4/1986 Moore et al.
4,592,423 A 6/1986 Savage et al.
4,597,441 A 7/1986 Ware et al.
4,597,444 A 7/1986 Hutchinson
4,598,392 A 7/1986 Pann
4,598,770 A 7/1986 Shu et al.
4,598,772 A 7/1986 Holmes
4,605,489 A 8/1986 Madgavkar
4,605,680 A 8/1986 Beuther et al.
4,608,818 A 9/1986 Goebel et al.
4,609,041 A 9/1986 Magda
4,613,754 A 9/1986 Vinegar et al.
4,616,705 A 10/1986 Stegemeier et al.
4,623,401 A 11/1986 Derbyshire et al.
4,623,444 A 11/1986 Che et al.
4,626,665 A 12/1986 Fort, III
4,634,187 A 1/1987 Huff et al.
4,635,197 A 1/1987 Vinegar et al.
4,637,464 A 1/1987 Forgac et al.
4,640,352 A 2/1987 Van Meurs et al.
4,640,353 A 2/1987 Schuh
4,643,256 A 2/1987 Dilgren et al.
4,644,283 A 2/1987 Vinegar et al.
4,645,906 A 2/1987 Yagnik et al.
4,651,825 A 3/1987 Wilson
4,658,215 A 4/1987 Vinegar et al.

(56) References Cited

U.S. PATENT DOCUMENTS 4,662,437 A 5/1987 Renfro et al.
4,662,438 A 5/1987 Taflove et al.
4,662,439 A 5/1987 Puri
4,662,443 A 5/1987 Puri et al.
4,663,711 A 5/1987 Vinegar et al.
4,669,542 A 6/1987 Venkatesan
4,670,634 A 6/1987 Bridges et al.
4,671,102 A 6/1987 Vinegar et al.
4,682,652 A 7/1987 Huang et al.
4,691,771 A 9/1987 Ware et al.
4,694,907 A 9/1987 Stahl et al.
4,695,713 A 9/1987 Krumme
4,696,345 A 9/1987 Hsueh
4,698,149 A 10/1987 Mitchell
4,698,583 A 10/1987 Sandberg
4,701,587 A 10/1987 Carter et al.
4,704,514 A 11/1987 Van Edmond et al.
4,706,751 A 11/1987 Gondouin
4,716,960 A 1/1988 Eastlund et al.
4,717,814 A 1/1988 Krumme
4,719,423 A 1/1988 Vinegar et al.
4,728,892 A 3/1988 Vinegar et al.
4,730,162 A 3/1988 Vinegar et al.
4,733,057 A 3/1988 Stanzel et al.
4,734,115 A 3/1988 Howard et al.
4,743,854 A 5/1988 Vinegar et al.
4,744,245 A 5/1988 White
4,752,673 A 6/1988 Krumme
4,756,367 A 7/1988 Puri et al.
4,762,425 A 8/1988 Shakkottai et al.
4,766,958 A 8/1988 Faecke
4,769,602 A 9/1988 Vinegar et al.
4,769,606 A 9/1988 Vinegar et al.
4,772,634 A 9/1988 Farooque
4,776,638 A 10/1988 Hahn
4,778,586 A 10/1988 Bain et al.
4,785,163 A 11/1988 Sandberg
4,787,452 A 11/1988 Jennings, Jr.
4,793,409 A 12/1988 Bridges et al.
4,794,226 A 12/1988 Derbyshire
4,808,925 A 2/1989 Baird
4,814,587 A 3/1989 Carter
4,815,791 A 3/1989 Schmidt et al.
4,817,711 A 4/1989 Jeambey
4,818,370 A 4/1989 Gregoli et al.
4,821,798 A 4/1989 Bridges et al.
4,823,890 A 4/1989 Lang
4,827,761 A 5/1989 Vinegar et al.
4,828,031 A 5/1989 Davis
4,842,070 A 6/1989 Sharp
4,842,448 A 6/1989 Koerner et al.
4,848,460 A 7/1989 Johnson, Jr. et al.
4,848,924 A 7/1989 Nuspl et al.
4,849,611 A 7/1989 Whitney et al.
4,856,341 A 8/1989 Vinegar et al.
4,856,587 A 8/1989 Nielson
4,860,544 A 8/1989 Krieg et al.
4,866,983 A 9/1989 Vinegar et al.
4,883,582 A 11/1989 McCants
4,884,455 A 12/1989 Vinegar et al.
4,884,635 A 12/1989 McKay et al.
4,885,080 A 12/1989 Brown et al.
4,886,118 A 12/1989 Van Meurs et al.
4,893,504 A 1/1990 OMeara, Jr. et al.
4,895,206 A 1/1990 Price
4,912,971 A 4/1990 Jeambey
4,913,065 A 4/1990 Hemsath
4,926,941 A 5/1990 Glandt et al.
4,927,857 A 5/1990 McShea, III et al.
4,928,765 A 5/1990 Nielson
4,940,095 A 7/1990 Newman
4,974,425 A 12/1990 Krieg et al.
4,982,786 A 1/1991 Jennings, Jr.
4,983,319 A 1/1991 Gregoli et al.
4,984,594 A 1/1991 Vinegar et al.
4,985,313 A 1/1991 Penneck et al.
4,987,368 A 1/1991 Vinegar
4,994,093 A 2/1991 Wetzel et al.
5,008,085 A 4/1991 Bain et al.
5,011,329 A 4/1991 Nelson et al.
5,014,788 A 5/1991 Puri et al.
5,020,596 A 6/1991 Hemsath
5,027,896 A 7/1991 Anderson
5,032,042 A 7/1991 Schuring et al.
5,041,210 A 8/1991 Merrill, Jr. et al.
5,042,579 A 8/1991 Glandt et al.
5,043,668 A 8/1991 Vail, III
5,046,559 A 9/1991 Glandt
5,046,560 A 9/1991 Teletzke et al.
5,050,386 A 9/1991 Krieg et al.
5,054,551 A 10/1991 Duerksen
5,059,303 A 10/1991 Taylor et al.
5,060,287 A 10/1991 Van Egmond
5,060,726 A 10/1991 Glandt et al.
5,064,006 A 11/1991 Waters et al.
5,065,501 A 11/1991 Henschen et al.
5,065,818 A 11/1991 Van Egmond
5,066,852 A 11/1991 Willbanks
5,070,533 A 12/1991 Bridges et al.
5,073,625 A 12/1991 Derbyshire
5,082,054 A 1/1992 Kiamanesh
5,082,055 A 1/1992 Hemsath
5,085,276 A 2/1992 Rivas et al.
5,097,903 A 3/1992 Wilensky
5,099,918 A 3/1992 Bridges et al.
5,103,909 A 4/1992 Morgenthaler et al.
5,103,920 A 4/1992 Patton
5,109,928 A 5/1992 McCants
5,126,037 A 6/1992 Showalter
5,133,406 A 7/1992 Puri
5,145,003 A 9/1992 Duerksen
5,152,341 A 10/1992 Kaservich
5,168,927 A 12/1992 Stegemeier et al.
5,182,427 A 1/1993 McGaffigan
5,182,792 A 1/1993 Goncalves
5,189,283 A 2/1993 Carl, Jr. et al.
5,190,405 A 3/1993 Vinegar et al.
5,193,618 A 3/1993 Loh et al.
5,201,219 A 4/1993 Bandurski et al.
5,207,273 A 5/1993 Cates et al.
5,209,987 A 5/1993 Penneck et al.
5,211,230 A 5/1993 Ostapovich et al.
5,217,075 A 6/1993 Wittrisch
5,217,076 A 6/1993 Masek
5,226,961 A 7/1993 Nahm et al.
5,229,583 A 7/1993 van Egmond et al.
5,236,039 A 8/1993 Edelstein et al.
5,246,071 A 9/1993 Chu
5,255,740 A 10/1993 Talley
5,255,742 A 10/1993 Mikus
5,261,490 A 11/1993 Ebinuma
5,285,071 A 2/1994 LaCount
5,285,846 A 2/1994 Mohn
5,289,882 A 3/1994 Moore
5,295,763 A 3/1994 Stenborg et al.
5,297,626 A 3/1994 Vinegar et al.
5,305,239 A 4/1994 Kinra
5,305,829 A 4/1994 Kumar
5,306,640 A 4/1994 Vinegar et al.
5,316,664 A 5/1994 Gregoli et al.
5,318,116 A 6/1994 Vinegar et al.
5,318,709 A 6/1994 Wuest et al.
5,325,918 A 7/1994 Berryman et al.
5,332,036 A 7/1994 Shirley et al.
5,339,897 A 8/1994 Leaute
5,339,904 A 8/1994 Jennings, Jr.
5,340,467 A 8/1994 Gregoli et al.
5,349,859 A 9/1994 Kleppe
5,350,014 A * 9/1994 McKay ..... 166/272.3
5,358,045 A 10/1994 Sevigny et al.
5,360,067 A 11/1994 Meo, III
5,363,094 A 11/1994 Staron et al.
5,366,012 A 11/1994 Lohbeck
5,377,756 A 1/1995 Northrop et al.

(56) References Cited

U.S. PATENT DOCUMENTS 5,388,640 A 2/1995 Puri et al.
5,388,641 A 2/1995 Yee et al.
5,388,642 A 2/1995 Puri et al.
5,388,643 A 2/1995 Yee et al.
5,388,645 A 2/1995 Puri et al.
5,391,291 A 2/1995 Winquist et al.
5,392,854 A 2/1995 Vinegar et al.
5,400,430 A 3/1995 Nenniger
5,402,847 A 4/1995 Wilson et al.
5,404,952 A 4/1995 Vinegar et al.
5,409,071 A 4/1995 Wellington et al.
5,411,086 A 5/1995 Burcham et al.
5,411,089 A 5/1995 Vinegar et al.
5,411,104 A 5/1995 Stanley
5,415,231 A 5/1995 Northrop et al.
5,431,224 A 7/1995 Laali
5,433,271 A 7/1995 Vinegar et al.
5,435,666 A 7/1995 Hassett et al.
5,437,506 A 8/1995 Gray
5,439,054 A 8/1995 Chaback et al.
5,454,666 A 10/1995 Chaback et al.
5,456,315 A 10/1995 Kisman et al.
5,484,020 A 1/1996 Cowan
5,491,969 A 2/1996 Cohn et al.
5,497,087 A 3/1996 Vinegar et al.
5,498,960 A 3/1996 Vinegar et al.
5,507,149 A 4/1996 Dash et al.
5,512,732 A 4/1996 Yagnik et al.
5,517,593 A 5/1996 Nenniger et al.
5,525,322 A 6/1996 Willms
5,541,517 A 7/1996 Hartmann et al.
5,545,803 A 8/1996 Heath et al.
5,553,189 A 9/1996 Stegemeier et al.
5,554,453 A 9/1996 Steinfeld et al.
5,566,755 A 10/1996 Seidle et al.
5,566,756 A 10/1996 Chaback et al.
5,571,403 A 11/1996 Scott et al.
5,579,575 A 12/1996 Lamome et al.
5,589,775 A 12/1996 Kuckes
5,621,844 A 4/1997 Bridges
5,621,845 A 4/1997 Bridges et al.
5,624,188 A 4/1997 West
5,632,336 A 5/1997 Notz et al.
5,652,389 A 7/1997 Schaps et al.
5,656,239 A 8/1997 Stegemeier et al.
RE35,696 E 12/1997 Mikus
5,713,415 A 2/1998 Bridges
5,723,423 A 3/1998 Van Slyke
5,751,895 A 5/1998 Bridges
5,759,022 A 6/1998 Koppang et al.
5,760,307 A 6/1998 Latimer et al.
5,769,569 A 6/1998 Hosseini
5,777,229 A 7/1998 Geier et al.
5,782,301 A 7/1998 Neuroth et al.
5,802,870 A 9/1998 Arnold et al.
5,826,653 A 10/1998 Rynne et al.
5,826,655 A 10/1998 Snow et al.
5,828,797 A 10/1998 Minott et al.
5,861,137 A 1/1999 Edlund
5,862,858 A 1/1999 Wellington et al.
5,868,202 A 2/1999 Hsu
5,879,110 A 3/1999 Carter
5,899,269 A 5/1999 Wellington et al.
5,899,958 A 5/1999 Dowell et al.
5,911,898 A 6/1999 Jacobs et al.
5,923,170 A 7/1999 Kuckes
5,926,437 A 7/1999 Ortiz
5,935,421 A 8/1999 Brons et al.
5,958,365 A 9/1999 Liu
5,968,349 A 10/1999 Duyvesteyn et al.
5,984,010 A 11/1999 Elias et al.
5,984,578 A 11/1999 Hanesian et al.
5,984,582 A 11/1999 Schwert
5,985,138 A 11/1999 Humphreys
5,992,522 A 11/1999 Boyd et al.
5,997,214 A 12/1999 de Rouffignac et al.
6,015,015 A 1/2000 Luft et al.
6,016,867 A 1/2000 Gregoli et al.
6,016,868 A 1/2000 Gregoli et al.
6,019,172 A 2/2000 Wellington et al.
6,022,834 A 2/2000 Hsu et al.
6,023,554 A 2/2000 Vinegar et al.
6,026,914 A 2/2000 Adams et al.
6,035,701 A 3/2000 Lowry et al.
6,039,121 A 3/2000 Kisman
6,049,508 A 4/2000 Deflandre
6,056,057 A 5/2000 Vinegar et al.
6,065,538 A 5/2000 Reimers et al.
6,078,868 A 6/2000 Dubinsky
6,079,499 A 6/2000 Mikus et al.
6,084,826 A 7/2000 Leggett, III
6,085,512 A 7/2000 Agee et al.
6,088,294 A 7/2000 Leggett, III et al.
6,094,048 A 7/2000 Vinegar et al.
6,099,208 A 8/2000 McAlister
6,102,122 A 8/2000 de Rouffignac
6,102,137 A 8/2000 Ward et al.
6,102,622 A 8/2000 Vinegar et al.
6,110,358 A 8/2000 Aldous et al.
6,112,808 A 9/2000 Isted
6,152,987 A 11/2000 Ma et al.
6,155,117 A 12/2000 Stevens et al.
6,172,124 B1 1/2001 Wolflick et al.
6,173,775 B1 1/2001 Elias et al.
6,192,748 B1 2/2001 Miller
6,193,010 B1 2/2001 Minto
6,196,350 B1 3/2001 Minto
6,244,338 B1 6/2001 Mones
6,257,334 B1 7/2001 Cyr et al.
6,269,310 B1 7/2001 Washbourne
6,269,881 B1 8/2001 Chou et al.
6,283,230 B1 9/2001 Peters
6,288,372 B1 9/2001 Sandberg et al.
6,328,104 B1 12/2001 Graue
6,353,706 B1 3/2002 Bridges
6,354,373 B1 3/2002 Vercaemer et al.
6,357,526 B1 3/2002 Abdel-Halim et al.
6,388,947 B1 5/2002 Washbourne et al.
6,412,559 B1 7/2002 Gunter et al.
6,422,318 B1 7/2002 Rider
6,427,124 B1 7/2002 Dubinsky et al.
6,429,784 B1 8/2002 Beique et al.
6,467,543 B1 10/2002 Talwani et al.
6,485,232 B1 11/2002 Vinegar et al.
6,499,536 B1 12/2002 Ellingsen
6,516,891 B1 2/2003 Dallas
6,540,018 B1 4/2003 Vinegar
6,581,684 B2 6/2003 Wellington et al.
6,584,406 B1 6/2003 Harmon et al.
6,585,046 B2 7/2003 Neuroth et al.
6,588,266 B2 7/2003 Tubel et al.
6,588,503 B2 7/2003 Karanikas et al.
6,588,504 B2 7/2003 Wellington et al.
6,591,906 B2 7/2003 Wellington et al.
6,591,907 B2 7/2003 Zhang et al.
6,607,033 B2 8/2003 Wellington et al.
6,609,570 B2 8/2003 Wellington et al.
6,679,332 B2 1/2004 Vinegar et al.
6,684,948 B1 2/2004 Savage
6,688,387 B1 2/2004 Wellington et al.
6,698,515 B2 3/2004 Karanikas et al.
6,702,016 B2 3/2004 de Rouffignac et al.
6,708,758 B2 3/2004 de Rouffignac et al.
6,712,135 B2 3/2004 Wellington et al.
6,712,136 B2 3/2004 de Rouffignac et al.
6,712,137 B2 3/2004 Vinegar et al.
6,715,546 B2 4/2004 Vinegar et al.
6,715,547 B2 4/2004 Vinegar et al.
6,715,548 B2 4/2004 Wellington et al.
6,715,550 B2 4/2004 Vinegar et al.
6,719,047 B2 4/2004 Fowler et al.
6,722,429 B2 4/2004 de Rouffignac et al.
6,722,430 B2 4/2004 Vinegar et al.
6,722,431 B2 4/2004 Karanikas et al.

(56) References Cited

U.S. PATENT DOCUMENTS 6,725,920 B2 4/2004 Zhang et al.
6,725,928 B2 4/2004 Vinegar et al.
6,729,395 B2 5/2004 Shahin, Jr. et al.
6,729,396 B2 5/2004 Vinegar et al.
6,729,397 B2 5/2004 Zhang et al.
6,729,401 B2 5/2004 Vinegar et al.
6,732,794 B2 5/2004 Wellington et al.
6,732,795 B2 5/2004 de Rouffignac et al.
6,732,796 B2 5/2004 Vinegar et al.
6,736,215 B2 5/2004 Maher et al.
6,739,393 B2 5/2004 Vinegar et al.
6,739,394 B2 5/2004 Vinegar et al.
6,742,587 B2 6/2004 Vinegar et al.
6,742,588 B2 6/2004 Wellington et al.
6,742,589 B2 6/2004 Berchenko et al.
6,742,593 B2 6/2004 Vinegar et al.
6,745,831 B2 6/2004 de Rouffignac et al.
6,745,832 B2 6/2004 Wellington et al.
6,745,837 B2 6/2004 Wellington et al.
6,749,021 B2 6/2004 Vinegar et al.
6,752,210 B2 6/2004 de Rouffignac et al.
6,755,251 B2 6/2004 Thomas et al.
6,758,268 B2 7/2004 Vinegar et al.
6,761,216 B2 7/2004 Vinegar et al.
6,763,886 B2 7/2004 Schoeling et al.
6,769,483 B2 8/2004 de Rouffignac et al.
6,769,485 B2 8/2004 Vinegar et al.
6,782,947 B2 8/2004 de Rouffignac et al.
6,789,625 B2 9/2004 de Rouffignac et al.
6,796,139 B2 9/2004 Briley et al.
6,805,194 B2 10/2004 Davidson et al.
6,805,195 B2 10/2004 Vinegar et al.
6,820,688 B2 11/2004 Vinegar et al.
6,854,534 B2 2/2005 Livingstone
6,854,929 B2 2/2005 Vinegar et al.
6,866,097 B2 3/2005 Vinegar et al.
6,871,707 B2 3/2005 Karanikas et al.
6,877,554 B2 4/2005 Stegemeier et al.
6,877,555 B2 4/2005 Karanikas et al.
6,880,633 B2 4/2005 Wellington et al.
6,880,635 B2 4/2005 Vinegar et al.
6,889,769 B2 5/2005 Wellington et al.
6,896,053 B2 5/2005 Berchenko et al.
6,902,003 B2 6/2005 Maher et al.
6,902,004 B2 6/2005 de Rouffignac et al.
6,910,536 B2 6/2005 Wellington et al.
6,910,537 B2 6/2005 Brown et al.
6,913,078 B2 7/2005 Shahin, Jr. et al.
6,913,079 B2 7/2005 Tubel
6,915,850 B2 7/2005 Vinegar et al.
6,918,442 B2 7/2005 Wellington et al.
6,918,443 B2 7/2005 Wellington et al.
6,918,444 B2 7/2005 Passey
6,923,257 B2 8/2005 Wellington et al.
6,923,258 B2 8/2005 Wellington et al.
6,929,067 B2 8/2005 Vinegar et al.
6,932,155 B2 8/2005 Vinegar et al.
6,942,032 B2 9/2005 La Rovere et al.
6,942,037 B1 9/2005 Arnold
6,948,562 B2 9/2005 Wellington et al.
6,948,563 B2 9/2005 Wellington et al.
6,951,247 B2 10/2005 de Rouffignac et al.
6,951,250 B2 10/2005 Reddy et al.
6,953,087 B2 10/2005 de Rouffignac et al.
6,958,704 B2 10/2005 Vinegar et al.
6,959,761 B2 11/2005 Berchenko et al.
6,964,300 B2 11/2005 Vinegar et al.
6,966,372 B2 11/2005 Wellington et al.
6,966,374 B2 11/2005 Vinegar et al.
6,969,123 B2 11/2005 Vinegar et al.
6,973,967 B2 12/2005 Stegemeier et al.
6,981,548 B2 1/2006 Wellington et al.
6,981,553 B2 1/2006 Stegemeier et al.
6,991,032 B2 1/2006 Berchenko et al.
6,991,033 B2 1/2006 Wellington et al.
6,991,036 B2 1/2006 Sumnu-Dindoruk et al.
6,991,045 B2 * 1/2006 Vinegar et al. ..... 175/45
6,994,160 B2 2/2006 Wellington et al.
6,994,168 B2 2/2006 Wellington et al.
6,994,169 B2 2/2006 Zhang et al.
6,995,646 B1 2/2006 Fromm et al.
6,997,255 B2 2/2006 Wellington et al.
6,997,518 B2 2/2006 Vinegar et al.
7,004,247 B2 2/2006 Cole et al.
7,004,251 B2 2/2006 Ward et al.
7,011,154 B2 3/2006 Maher et al.
7,013,972 B2 3/2006 Vinegar et al.
RE39,077 E 4/2006 Eaton
7,032,660 B2 4/2006 Vinegar et al.
7,032,809 B1 4/2006 Hopkins
7,036,583 B2 5/2006 de Rouffignac et al.
7,040,397 B2 5/2006 de Rouffignac et al.
7,040,398 B2 5/2006 Wellington et al.
7,040,399 B2 5/2006 Wellington et al.
7,040,400 B2 5/2006 de Rouffignac et al.
7,048,051 B2 5/2006 McQueen
7,051,807 B2 5/2006 Vinegar et al.
7,051,808 B1 5/2006 Vinegar et al.
7,051,811 B2 5/2006 de Rouffignac et al.
7,055,600 B2 6/2006 Messier et al.
7,055,602 B2 6/2006 Shpakoff et al.
7,063,145 B2 6/2006 Veenstra et al.
7,066,254 B2 6/2006 Vinegar et al.
7,066,257 B2 6/2006 Wellington et al.
7,073,578 B2 7/2006 Vinegar et al.
7,077,198 B2 7/2006 Vinegar et al.
7,077,199 B2 7/2006 Vinegar et al.
RE39,244 E 8/2006 Eaton
7,086,465 B2 8/2006 Wellington et al.
7,086,468 B2 8/2006 de Rouffignac et al.
7,090,013 B2 8/2006 Wellington et al.
7,096,941 B2 8/2006 de Rouffignac et al.
7,096,942 B1 8/2006 de Rouffignac et al.
7,096,953 B2 8/2006 de Rouffignac et al.
7,100,994 B2 9/2006 Vinegar et al.
7,104,319 B2 9/2006 Vinegar et al.
7,114,566 B2 10/2006 Vinegar et al.
7,114,880 B2 10/2006 Carter
7,121,341 B2 10/2006 Vinegar et al.
7,121,342 B2 10/2006 Vinegar et al.
7,128,150 B2 10/2006 Thomas et al.
7,128,153 B2 10/2006 Vinegar et al.
7,147,057 B2 12/2006 Steele et al.
7,147,059 B2 12/2006 Vinegar et al.
7,153,373 B2 12/2006 Maziasz et al.
3,362,751 A1 1/2007 Tinlin
7,156,176 B2 1/2007 Vinegar et al.
7,165,615 B2 1/2007 Vinegar et al.
7,170,424 B2 1/2007 Vinegar et al.
7,204,327 B2 4/2007 Livingstone
7,219,734 B2 5/2007 Bai et al.
7,225,866 B2 6/2007 Berchenko et al.
3,412,011 A1 7/2007 Lindsay
7,259,688 B2 8/2007 Hirsch et al.
7,320,364 B2 1/2008 Fairbanks
7,331,385 B2 2/2008 Symington et al.
7,353,872 B2 4/2008 Sandberg et al.
7,357,180 B2 4/2008 Vinegar et al.
7,360,588 B2 4/2008 Vinegar et al.
7,370,704 B2 5/2008 Harris
7,383,877 B2 6/2008 Vinegar et al.
7,424,915 B2 9/2008 Vinegar et al.
7,431,076 B2 10/2008 Sandberg et al.
7,435,037 B2 10/2008 McKinzie, II
7,461,691 B2 12/2008 Vinegar et al.
7,481,274 B2 1/2009 Vinegar et al.
7,490,665 B2 2/2009 Sandberg et al.
7,500,528 B2 3/2009 McKinzie et al.
7,510,000 B2 3/2009 Pastor-Sanz et al.
7,527,094 B2 5/2009 McKinzie et al.
7,533,719 B2 5/2009 Hinson et al.
7,540,324 B2 6/2009 de Rouffignac et al.
7,546,873 B2 6/2009 Kim
7,549,470 B2 6/2009 Vinegar et al.

(56) References Cited

U.S. PATENT DOCUMENTS

| | | | |
|---|---|---|---|
| 7,556,095 | B2 | 7/2009 | Vinegar |
| 7,556,096 | B2 | 7/2009 | Vinegar et al. |
| 7,559,367 | B2 | 7/2009 | Vinegar et al. |
| 7,559,368 | B2 | 7/2009 | Vinegar |
| 7,562,706 | B2 | 7/2009 | Li et al. |
| 7,562,707 | B2 | 7/2009 | Miller |
| 7,575,052 | B2 | 8/2009 | Sandberg et al. |
| 7,575,053 | B2 | 8/2009 | Vinegar et al. |
| 7,581,589 | B2 | 9/2009 | Roes et al. |
| 7,584,789 | B2 | 9/2009 | Mo et al. |
| 7,591,310 | B2 | 9/2009 | Minderhoud et al. |
| 7,597,147 | B2 | 10/2009 | Vitek et al. |
| 7,604,052 | B2 | 10/2009 | Roes et al. |
| 7,610,962 | B2 | 11/2009 | Fowler |
| 7,631,689 | B2 | 12/2009 | Vinegar et al. |
| 7,631,690 | B2 | 12/2009 | Vinegar et al. |
| 7,635,023 | B2 | 12/2009 | Goldberg et al. |
| 7,635,024 | B2 | 12/2009 | Karanikas et al. |
| 7,635,025 | B2 | 12/2009 | Vinegar et al. |
| 7,640,980 | B2 | 1/2010 | Vinegar et al. |
| 7,644,765 | B2 | 1/2010 | Stegemeier et al. |
| 7,673,681 | B2 | 3/2010 | Vinegar et al. |
| 7,673,786 | B2 | 3/2010 | Menotti |
| 7,677,310 | B2 | 3/2010 | Vinegar et al. |
| 7,677,314 | B2 | 3/2010 | Hsu |
| 7,681,647 | B2 | 3/2010 | Mudunuri et al. |
| 7,683,296 | B2 | 3/2010 | Brady et al. |
| 7,703,513 | B2 | 4/2010 | Vinegar et al. |
| 7,717,171 | B2 | 5/2010 | Stegemeier et al. |
| 7,730,945 | B2 | 6/2010 | Pietersen et al. |
| 7,730,946 | B2 | 6/2010 | Vinegar et al. |
| 7,730,947 | B2 | 6/2010 | Stegemeier et al. |
| 7,735,935 | B2 | 6/2010 | Vinegar et al. |
| 7,743,826 | B2 | 6/2010 | Harris |
| 7,785,427 | B2 | 8/2010 | Maziasz et al. |
| 7,793,722 | B2 | 9/2010 | Vinegar et al. |
| 7,798,220 | B2 | 9/2010 | Vinegar et al. |
| 7,798,221 | B2 | 9/2010 | Vinegar et al. |
| 7,831,133 | B2 | 11/2010 | Vinegar et al. |
| 7,831,134 | B2 | 11/2010 | Vinegar et al. |
| 7,832,484 | B2 | 11/2010 | Nguyen et al. |
| 7,841,401 | B2 | 11/2010 | Kuhlman et al. |
| 7,841,408 | B2 | 11/2010 | Vinegar |
| 7,841,425 | B2 | 11/2010 | Mansure et al. |
| 7,845,411 | B2 | 12/2010 | Vinegar et al. |
| 7,849,922 | B2 | 12/2010 | Vinegar et al. |
| 7,860,377 | B2 | 12/2010 | Vinegar et al. |
| 7,866,385 | B2 | 1/2011 | Lambirth |
| 7,866,386 | B2 | 1/2011 | Beer |
| 7,866,388 | B2 | 1/2011 | Bravo |
| 7,931,086 | B2 | 4/2011 | Nguyen et al. |
| 7,942,197 | B2 | 5/2011 | Fairbanks et al. |
| 7,942,203 | B2 | 5/2011 | Vinegar et al. |
| 7,950,453 | B2 | 5/2011 | Farmayan et al. |
| 7,986,869 | B2 | 7/2011 | Vinegar et al. |
| 8,011,451 | B2 | 9/2011 | MacDonald |
| 8,027,571 | B2 | 9/2011 | Vinegar et al. |
| 8,042,610 | B2 | 10/2011 | Harris et al. |
| 8,070,840 | B2 | 12/2011 | Diaz et al. |
| 8,083,813 | B2 | 12/2011 | Nair et al. |
| 8,113,272 | B2 | 2/2012 | Vinegar |
| 8,146,661 | B2 | 4/2012 | Bravo et al. |
| 8,146,669 | B2 | 4/2012 | Mason |
| 8,151,880 | B2 | 4/2012 | Roes et al. |
| 8,162,043 | B2 | 4/2012 | Burnham et al. |
| 8,162,059 | B2 | 4/2012 | Nguyen et al. |
| 8,172,335 | B2 | 5/2012 | Burns et al. |
| 8,177,305 | B2 | 5/2012 | Burns et al. |
| 8,191,630 | B2 | 6/2012 | Stegemeier et al. |
| 8,196,658 | B2 | 6/2012 | Miller et al. |
| 8,200,072 | B2 | 6/2012 | Vinegar et al. |
| 8,220,539 | B2 | 7/2012 | Vinegar et al. |
| 8,224,164 | B2 | 7/2012 | Sandberg et al. |
| 8,224,165 | B2 | 7/2012 | Vinegar et al. |
| 8,225,866 | B2 | 7/2012 | de Rouffignac |
| 8,230,927 | B2 | 7/2012 | Fairbanks et al. |
| 8,233,782 | B2 | 7/2012 | Vinegar et al. |
| 8,238,730 | B2 | 8/2012 | Sandberg et al. |
| 8,240,774 | B2 | 8/2012 | Vinegar |
| 8,261,832 | B2 | 9/2012 | Ryan |
| 8,267,170 | B2 | 9/2012 | Fowler et al. |
| 8,267,185 | B2 | 9/2012 | Ocampos et al. |
| 8,276,661 | B2 | 10/2012 | Costello et al. |
| 8,281,861 | B2 | 10/2012 | Nguyen et al. |
| 8,327,932 | B2 | 12/2012 | Karanikas |
| 8,355,623 | B2 | 1/2013 | Vinegar et al. |
| 8,381,815 | B2 | 2/2013 | Karanikas et al. |
| 8,434,555 | B2 | 5/2013 | Bos et al. |
| 8,450,540 | B2 | 5/2013 | Roes et al. |
| 8,459,359 | B2 | 6/2013 | Vinegar |
| 8,485,252 | B2 | 7/2013 | de Rouffignac |
| 8,485,847 | B2 | 7/2013 | Tilley |
| 8,555,971 | B2 | 10/2013 | Vinegar et al. |
| 8,562,078 | B2 | 10/2013 | Burns et al. |
| 8,627,887 | B2 | 1/2014 | Vinegar et al. |
| 8,631,866 | B2 | 1/2014 | Nguyen |
| 8,636,323 | B2 | 1/2014 | Prince-Wright et al. |
| 8,662,175 | B2 | 3/2014 | Karanikas et al. |
| 8,701,768 | B2 | 4/2014 | Marino et al. |
| 8,701,769 | B2 | 4/2014 | Beer |
| 2002/0027001 | A1 | 3/2002 | Wellington et al. |
| 2002/0028070 | A1 | 3/2002 | Holen |
| 2002/0033253 | A1 | 3/2002 | de Rouffignac et al. |
| 2002/0036089 | A1 | 3/2002 | Vinegar et al. |
| 2002/0038069 | A1 | 3/2002 | Wellington et al. |
| 2002/0040779 | A1 | 4/2002 | Wellington et al. |
| 2002/0040780 | A1 | 4/2002 | Wellington et al. |
| 2002/0053431 | A1 | 5/2002 | Wellington et al. |
| 2002/0076212 | A1 | 6/2002 | Zhang et al. |
| 2002/0112890 | A1 | 8/2002 | Wentworth et al. |
| 2002/0112987 | A1 | 8/2002 | Hou et al. |
| 2002/0153141 | A1 | 10/2002 | Hartman et al. |
| 2003/0029617 | A1 | 2/2003 | Brown et al. |
| 2003/0066642 | A1 | 4/2003 | Wellington et al. |
| 2003/0079877 | A1 | 5/2003 | Wellington et al. |
| 2003/0085034 | A1 | 5/2003 | Wellington et al. |
| 2003/0131989 | A1 | 7/2003 | Zakiewicz |
| 2003/0146002 | A1 | 8/2003 | Vinegar et al. |
| 2003/0157380 | A1 | 8/2003 | Assarabowski et al. |
| 2003/0196789 | A1 | 10/2003 | Wellington et al. |
| 2003/0201098 | A1 | 10/2003 | Karanikas et al. |
| 2004/0035582 | A1 | 2/2004 | Zupanick |
| 2004/0140096 | A1 | 7/2004 | Sandberg et al. |
| 2004/0144540 | A1 | 7/2004 | Sandberg et al. |
| 2004/0146288 | A1 | 7/2004 | Vinegar et al. |
| 2005/0006097 | A1 | 1/2005 | Sandberg et al. |
| 2005/0045325 | A1 | 3/2005 | Yu |
| 2005/0269313 | A1 | 12/2005 | Vinegar et al. |
| 2006/0052905 | A1 | 3/2006 | Pfingsten et al. |
| 2006/0116430 | A1 | 6/2006 | Wentink |
| 2006/0175061 | A1 | 8/2006 | Crichlow |
| 2006/0289536 | A1 | 12/2006 | Vinegar et al. |
| 2007/0044957 | A1 | 3/2007 | Watson et al. |
| 2007/0045267 | A1 | 3/2007 | Vinegar et al. |
| 2007/0119098 | A1 | 5/2007 | Diaz et al. |
| 2007/0127897 | A1 | 6/2007 | John et al. |
| 2007/0131427 | A1* | 6/2007 | Li et al. ..... 166/302 |
| 2007/0131428 | A1 | 6/2007 | den Boestert et al. |
| 2007/0133959 | A1 | 6/2007 | Vinegar et al. |
| 2007/0193743 | A1 | 8/2007 | Harris et al. |
| 2007/0246994 | A1 | 10/2007 | Kaminsky et al. |
| 2008/0006410 | A1 | 1/2008 | Looney et al. |
| 2008/0017380 | A1 | 1/2008 | Vinegar et al. |
| 2008/0017416 | A1 | 1/2008 | Watson et al. |
| 2008/0035346 | A1 | 2/2008 | Nair et al. |
| 2008/0035347 | A1 | 2/2008 | Brady et al. |
| 2008/0035705 | A1 | 2/2008 | Menotti |
| 2008/0038144 | A1 | 2/2008 | Maziasz et al. |
| 2008/0078551 | A1 | 4/2008 | De Vault et al. |
| 2008/0078552 | A1 | 4/2008 | Donnelly et al. |
| 2008/0128134 | A1 | 6/2008 | Mudunuri et al. |
| 2008/0135253 | A1 | 6/2008 | Vinegar et al. |
| 2008/0135254 | A1 | 6/2008 | Vinegar et al. |
| 2008/0142216 | A1 | 6/2008 | Vinegar et al. |

(56) References Cited

U.S. PATENT DOCUMENTS

| | | | |
|---|---|---|---|
| 2008/0142217 | A1 | 6/2008 | Pietersen et al. |
| 2008/0173442 | A1 | 7/2008 | Vinegar et al. |
| 2008/0173444 | A1 | 7/2008 | Stone et al. |
| 2008/0174115 | A1 | 7/2008 | Lambirth |
| 2008/0185147 | A1 | 8/2008 | Vinegar et al. |
| 2008/0217003 | A1 | 9/2008 | Kuhlman et al. |
| 2008/0217321 | A1 | 9/2008 | Vinegar et al. |
| 2008/0236831 | A1 | 10/2008 | Hsu et al. |
| 2008/0277113 | A1 | 11/2008 | Stegemeier et al. |
| 2008/0283241 | A1 | 11/2008 | Kaminsky et al. |
| 2009/0014180 | A1 | 1/2009 | Stegemeier et al. |
| 2009/0014181 | A1 | 1/2009 | Vinegar et al. |
| 2009/0038795 | A1 | 2/2009 | Kaminsky |
| 2009/0071652 | A1 | 3/2009 | Vinegar et al. |
| 2009/0084547 | A1 | 4/2009 | Farmayan et al. |
| 2009/0090158 | A1 | 4/2009 | Davidson et al. |
| 2009/0090509 | A1 | 4/2009 | Vinegar et al. |
| 2009/0095476 | A1 | 4/2009 | Nguyen et al. |
| 2009/0095477 | A1 | 4/2009 | Nguyen et al. |
| 2009/0095478 | A1 | 4/2009 | Karanikas et al. |
| 2009/0095479 | A1 | 4/2009 | Karanikas et al. |
| 2009/0095480 | A1 | 4/2009 | Vinegar et al. |
| 2009/0101346 | A1 | 4/2009 | Vinegar et al. |
| 2009/0120646 | A1 | 5/2009 | Kim et al. |
| 2009/0126929 | A1 | 5/2009 | Vinegar |
| 2009/0139716 | A1 | 6/2009 | Brock et al. |
| 2009/0189617 | A1 | 7/2009 | Burns et al. |
| 2009/0194329 | A1 | 8/2009 | Guimerans et al. |
| 2009/0194524 | A1 | 8/2009 | Kim et al. |
| 2009/0200023 | A1 | 8/2009 | Costello et al. |
| 2009/0200031 | A1 | 8/2009 | Miller |
| 2009/0200290 | A1 | 8/2009 | Cardinal et al. |
| 2009/0200854 | A1 | 8/2009 | Vinegar |
| 2009/0260811 | A1 | 10/2009 | Cui et al. |
| 2009/0294332 | A1 | 12/2009 | Ryu |
| 2009/0321417 | A1 | 12/2009 | Burns et al. |
| 2010/0044042 | A1 | 2/2010 | Carter |
| 2010/0071903 | A1 | 3/2010 | Prince-Wright et al. |
| 2010/0071904 | A1 | 3/2010 | Burns et al. |
| 2010/0089584 | A1 | 4/2010 | Burns |
| 2010/0089586 | A1 | 4/2010 | Stanecki |
| 2010/0096137 | A1 | 4/2010 | Nguyen et al. |
| 2010/0101783 | A1 | 4/2010 | Vinegar et al. |
| 2010/0101784 | A1 | 4/2010 | Vinegar et al. |
| 2010/0101794 | A1 | 4/2010 | Ryan |
| 2010/0108310 | A1 | 5/2010 | Fowler et al. |
| 2010/0108379 | A1 | 5/2010 | Edbury et al. |
| 2010/0155070 | A1 | 6/2010 | Roes et al. |
| 2010/0258265 | A1 | 10/2010 | Karanikas et al. |
| 2010/0258290 | A1 | 10/2010 | Bass |
| 2010/0258291 | A1 | 10/2010 | de St. Remey et al. |
| 2010/0258309 | A1 | 10/2010 | Ayodele et al. |
| 2010/0288497 | A1 | 11/2010 | Burnham et al. |
| 2011/0042085 | A1 | 2/2011 | Diehl |
| 2011/0132600 | A1 | 6/2011 | Kaminsky et al. |
| 2011/0247802 | A1 | 10/2011 | Deeg et al. |
| 2011/0247809 | A1 | 10/2011 | Lin et al. |
| 2011/0247819 | A1 | 10/2011 | Nguyen et al. |
| 2011/0247820 | A1 | 10/2011 | Marino et al. |
| 2011/0259590 | A1 | 10/2011 | Burnham et al. |
| 2011/0259591 | A1 | 10/2011 | Vinegar |
| 2012/0018421 | A1 | 1/2012 | Parman et al. |
| 2012/0205109 | A1 | 8/2012 | Burnham et al. |

FOREIGN PATENT DOCUMENTS

| | | |
|---|---|---|
| CA | 1253555 | 5/1989 |
| CA | 1288043 | 8/1991 |
| CA | 2015460 | 10/1991 |
| EP | 0940558 | 9/1999 |
| GB | 156396 | 1/1921 |
| GB | 674082 | 7/1950 |
| GB | 1010023 | 11/1965 |
| SE | 121737 | 5/1948 |
| SE | 123136 | 11/1948 |
| SE | 123137 | 11/1948 |
| SE | 123138 | 11/1948 |
| SE | 126674 | 11/1949 |
| SU | 1836876 | 12/1990 |
| WO | 9506093 | 3/1995 |
| WO | 9901640 | 1/1999 |
| WO | 0181505 | 11/2001 |
| WO | 2008048448 | 4/2008 |
| WO | 2008150531 | 12/2008 |

OTHER PUBLICATIONS

Beal, C. "The Viscosity of Air, Water, Natural Gas, Crude Oil and its Associated Gases at Oil Field Temperature and Pressures" TP 2018 in Petroleum Technology, Mar. 1946, pp. 94-115.

Cary, J. W., Martland, H. F., "Salt and Water Movement in Unsaturated Frozen Soil" Soil Science Society of America, Proceedings, Jul.-Aug. 1972, vol. 36, No. 4, pp. 549-555.

Dash, J. G. "Thermomolecular Pressure in Surface Melting: Motication for Frost Heave" Science, Dec. 22, 1989, vol. 246, pp. 1591-1593.

Gross et al. "Recent Experimental Work on Solute Redistribution at the Ice/Water Interface. Implications for Electrical Properties and Interface Process" J. de Physique Colloque C1, supplement au No. 3, vol. 48, Mar. 1987, pp. C1-527-C1529.

Hallet, B. "Solute Redistribution in Freezing Ground" Proceeding of the Third International Conference on Permafrost, Edmonton, Alberta, 1978, pp. 86-91.

Harris, J.S. "Ground Freezing in Practice" Telford, 1995, pp. 1-264.

Hofmann et al. "Redistribution of Soil Water and Solutes in Fine and Coarse Textured Soils After Freezing" Proc. Intl. Symp. on Agricultural, Range, and Forest Lands, Mar. 21-22, 1990, Spokane, CCREL Special Report 90-1, K. R. Cooley, Ed., pp. 263-270.

Andersland et al., "Heat Flow in Soils" of Frozen Ground Engineering, ASCE Press, 2004, pp. 93-98.

Iskandar, I. K. "Effect of Freezing on the Level of Contaminants in Uncontrolled Hazardous Waste Sites" U.S. Army Corp of Engineers Special Report 86-19, Jul. 1986, pp. 1-33.

Oberlander et al. "Mitigative Techniques for Ground-Water Contamination Associated with Severe Nuclear Accidents", NUREG/CR-4251, PNL-5461. vol. 1, Aug. 1985, pp. 4.103-4.110.

Matthews et al. "Pressure Buildup and Flow Tests in Wells" Society of Petroleum Engineers, 1967, pp. 1-172.

Sanger, F. J. "Ground Freezing in Construction" J. Proceedings of the American Society of Civil Engineers, Jan. 1968, pp. 131-156.

Sullivan, Jr. et al. "Comparison of Numerical Simulations with Experimental Data for a Prototype Artificial Ground Freezing" Proc. Intl. Symp. on Frozen Soil Impacts on Agricultural, Range, and Forest Lands, CCREL Special Report 90-1, K. R. Cooley, ed., pp. 36-43.

Swatzell et al. "Frozen Soil Barrier Technology" U.S. Dept. of Energy, Innovative Technology Summary Report, Apr. 1995, 32 pp.

"Frozen Soil Barrier" U.S. Dept. of Energy, Innovative Technology Summary Report, DOE/EM-0483, Oct. 1999, 27 pp.

PCT "International Search Report and Written Opinon" for International Application No. PCT/US11/031559, mailed , Jun. 8, 2011; 5 pages.

Hill et al., "The Characteristics of a Low Temperature in situ Shale Oil" American Institute of Mining, Metalurgical & Petroleum Engineers, 1967 (pp. 75-90).

Rouffignac, E. In Situ Resistive Heating of Oil Shale for Oil Production—A Summary of the Swedish Data, (4 pages), published prior to Oct. 2001.

SSAB report, "A Brief Description of the Ljungstrom Method for Shale Oil Production," 1950, (12 pages).

Salomonsson G., SSAB report, "The Lungstrom In Situ-Method for Shale Oil Recovery," 1950 (28 pages).

"Swedish shale oil-Production method in Sweden," Organisation for European Economic Co-operation, 1952, (70 pages).

SSAB report, "Kvarn Torp" 1958, (36 pages).

SSAB report, "Kvarn Torp" 1951 (35 pages).

SSAB report, "Summary study of the shale oil works at Narkes Kvarntorp" (15 pages), published prior to Oct. 2001.

(56) References Cited

OTHER PUBLICATIONS

Vogel et al. "An Analog Computer for Studying Heat Transfrer during a Thermal Recovery Process," AIME Petroleum Transactions, 1955 (pp. 205-212).
SAAB report, "The Swedish Shale Oil Industry," 1948 (8 pages).
Gejrot et al., "The Shale Oil Industry in Sweden," Carlo Colombo Publishers—Rome, Proceedings of the Fourth World Petroleum Congress, 1955 (8 pages).
Hedback, T. J., The Swedish Shale as Raw Material for Production of Power, Oil and Gas, XIth Sectional Meeting World Power Conference, 1957 (9 pages).
SAAB, "Santa Cruz, California, Field Test of the Lins Method for the Recovery of Oil from Sand", 1955, vol. 1, (141 pages) English.
SAAB, "Santa Cruz, California, Field Test of the Lins Method for the Recovery of Oil from Sand-Figures", 1955 vol. 2, (146 pages) English.
Helander, R.E., "Santa Cruz, California, Field Test of Carbon Steel Burner Casings for the Lins Method of Oil Recovery", 1959 (38 pages) English.
Helander et al., Santa Cruz, California, Field Test of Fluidized Bed Burners for the Lins Method of Oil Recovery 1959, (86 pages) English.
"Lins Burner Test Results—English" 1959-1960, (148 pages).
SAAB, "Photos", (18 pages), published prior to Oct. 2001.
Reaction Kinetics Between CO2 and Oil Shale Char, A.K. Burnham, Mar. 22, 1978 (18 pages).
Reaction Kinetics Between CO2 and Oil Shale Residual Carbon. I. Effect of Heating Rate on Reactivity, Alan K. Burnham, Jul. 11, 1978 (22 pages).
High-Pressure Pyrolysis of Colorado Oil Shale, Alan K. Burnham & Mary F. Singleton, Oct. 1982 (23 pages).
A Possible Mechanism of Alkene/Alkane Production in Oil Shale Retorting, A.K. Burnham, R.L. Ward, Nov. 26, 1980 (20 pages).
Enthalpy Relations for Eastern Oil Shale, David W. Camp, Nov. 1987 (13 pages).
Oil Shale Retorting: Part 3 A Correlation of Shale Oil 1-Alkene/n-Alkane Ratios With Yield, Coburn et al., Aug. 1, 1977 (18 pages).
The Composition of Green River Shale Oil, Glen L. Cook, et al., 1968 (12 pages).
Thermal Degradation of Green River Kerogen at 150o to 350o C Rate of Production Formation, J.J. Cummins & W.E. Robinson, 1972 (18 pages).
Retorting of Green River Oil Shale Under High-Pressure Hydrogen Atmospheres, LaRue et al., Jun. 1977 (38 pages).
Retorting and Combustion Processes in Surface Oil-Shale Retorts, A.E. Lewis & R.L. Braun, May 2, 1980 (12 pages).
Oil Shale Retorting Processes: A Technical Overview, Lewis et al., Mar. 1984 (18 pages).
Study of Gas Evolution During Oil Shale Pyrolysis by TQMS, Oh et al., Feb. 1988 (10 pages).
The Permittivity and Electrical Conductivity of Oil Shale, A.J. Piwinskii & A. Duba, Apr. 28, 1975 (12 pages).
Oil Degradation During Oil Shale Retorting, J.H. Raley & R.L. Braun, May 24, 1976 (14 pages).
Kinetic Analysis of California Oil Shale by Programmed Temperature Microphyrolysis, John G. Reynolds & Alan K. Burnham, Dec. 9, 1991 (14 pages).
Analysis of Oil Shale and Petroleum Source Rock Pyrolysis by Triple Quadrupole Mass Spectrometry: Comparisons of Gas Evolution at the Heating Rate of 10oC/Min., Reynolds et al. Oct. 5, 1990 (57 pages).
Fluidized-Bed Pyrolysis of Oil Shale, J.H. Richardson & E.B. Huss, Oct. 1981 (27 pages).
Retorting Kinetics for Oil Shale From Fluidized-Bed Pyrolysis, Richardson et al., Dec. 1981 (30 pages).
Recent Experimental Developments in Retorting Oil Shale at the Lawrence Livermore Laboratory, Albert J. Rothman, Aug. 1978 (32 pages).
The Lawrence Livermore Laboratory Oil Shale Retorts, Sandholtz et al. Sep. 18, 1978 (30 pages).
Operating Laboratory Oil Shale Retorts in an In-Situ Mode, W. A. Sandholtz et al., Aug. 18, 1977 (16 pages).
Some Relationships of Thermal Effects to Rubble-Bed Structure and Gas-Flow Patterns in Oil Shale Retorts, W. A. Sandholtz, Mar. 1980 (19 pages).
Assay Products from Green River Oil Shale, Singleton et al., Feb. 18, 1986 (213 pages).
Biomarkers in Oil Shale: Occurrence and Applications, Singleton et al., Oct. 1982 (28 pages).
Occurrence of Biomarkers in Green River Shale Oil, Singleton et al., Mar. 1983 (29 pages).
An Instrumentation Proposal for Retorts in the Demonstration Phase of Oil Shale Development, Clyde J. Sisemore, Apr. 19, 1977, (34 pages).
Pyrolysis Kinetics for Green River Oil Shale From the Saline Zone, Burnham et al., Feb. 1982 (33 pages).
SO2 Emissions from the Oxidation of Retorted Oil Shale, Taylor et al., Nov. 1981 (9 pages).
Nitric Oxide (NO) Reduction by Retorted Oil Shale, R.W. Taylor & C.J. Morris, Oct. 1983 (16 pages).
Coproduction of Oil and Electric Power from Colorado Oil Shale, P. Henrik Wallman, Sep. 24, 1991 (20 pages).
13C NMR Studies of Shale Oil, Raymond L. Ward & Alan K. Burnham, Aug. 1982 (22 pages).
Identification by 13C NMR of Carbon Types in Shale Oil and their Relationship to Pyrolysis Conditions, Raymond L. Ward & Alan K. Burnham, Sep. 1983 (27 pages).
A Laboratory Study of Green River Oil Shale Retorting Under Pressure in a Nitrogen Atmosphere, Wise et al., Sep. 1976 (24 pages).
Quantitative Analysis and Evolution of Sulfur-Containing Gases from Oil Shale Pyrolysis by Triple Quadrupole Mass Spectrometry, Wong et al., Nov. 1983 (34 pages).
Quantitative Analysis & Kinetics of Trace Sulfur Gas Species from Oil Shale Pyrolysis by Triple Quadrupole Mass Spectrometry (TQMS), Wong et al., Jul. 5-7, 1983 (34 pages).
Application of Self-Adaptive Detector System on a Triple Quadrupole MS/MS to High Expolsives and Sulfur-Containing Pyrolysis Gases from Oil Shale, Carla M. Wong & Richard W. Crawford, Oct. 1983 (17 pages).
An Evaluation of Triple Quadrupole MS/MS for On-Line Gas Analyses of Trace Sulfur Compounds from Oil Shale Processing, Wong et al., Jan. 1985 (30 pages).
General Model of Oil Shale Pyrolysis, Alan K. Burnham & Robert L. Braun, Nov. 1983 (22 pages).
Proposed Field Test of the Lins Mehtod Thermal Oil Recovery Process in Athabasca McMurray Tar Sands McMurray, Alberta; Husky Oil Company cody, Wyoming, circa 1960.
In Situ Measurement of Some Thermoporoelastic Parameters of a Granite, Berchenko et al., Poromechanics, A Tribute to Maurice Biot, 1998, p. 545-550.
Tar and Pitch, G. Collin and H. Hoeke. Ullmann's Encyclopedia of Industrial Chemistry, vol. A 26, 1995, p. 91-127.
Geology for Petroleum Exploration, Drilling, and Production. Hyne, Norman J. McGraw-Hill Book Company, 1984, p. 264.
Burnham, Alan, K. "Oil Shale Retorting Dependence of timing and composition on temperature and heating rate", Jan. 27, 1995, (23 pages).
Campbell, et al., "Kinetics of oil generation from Colorado Oil Shale" IPC Business Press, Fuel, 1978, (3 pages).
Some Effects of Pressure on Oil-Shale Retorting, Society of Petroleum Engineers Journal, J.H. Bae, Sep. 1969; pp. 287-292.
New in situ shale-oil recovery process uses hot natural gas; The Oil & Gas Journal; May 16, 1966, p. 151.
Evaluation of Downhole Electric Impedance Heating Systems for Paraffin Control in Oil Wells; Industry Applications Society 37th Annual Petroleum and Chemical Industry Conference; The Institute of Electrical and Electronics Engineers Inc., Bosch et al., Sep. 1990, pp. 223-227.
New System Stops Paraffin Build-up; Petroleum Engineer, Eastlund et al., Jan. 1989, (3 pages).
Oil Shale Retorting: Effects of Particle Size and Heating Rate on Oil Evolution and Intraparticle Oil Degradation; Campbell et al. In Situ 2(1), 1978, pp. 1-47.

(56) References Cited

OTHER PUBLICATIONS

The Potential for In Situ Retorting of Oil Shale in the Piceance Creek Basin of Northwestern Colorado; Dougan et al., Quarterly of the Colorado School of Mines, pp. 57-72 1970.
Retoring Oil Shale Underground—Problems & Possibilities; B.F. Grant, Qtly of Colorado School of Mines, pp. 39-46, 1960.
Molecular Mechanism of Oil Shale Pyrolysis in Nitrogen and Hydrogen Atmospheres, Hershkowitz et al.; Geochemistry and Chemistry of Oil Shales, American Chemical Society, May 1983 pp. 301-316.
The Characteristics of a Low Temperature in Situ Shale Oil; George Richard Hill & Paul Dougan, Quarterly of the Colorado School of Mines, 1967; pp. 75-90.
Direct Production of a Low Pour Point High Gravity Shale Oil; Hill et al., I & EC Product Research and Development, 6(1), Mar. 1967; pp. 52-59.
Refining of Swedish Shale Oil, L. Lundquist, pp. 621-627, 1951.
The Benefits of In Situ Upgrading Reactions to the Integrated Operations of the Orinoco Heavy-Oil Fields and Downstream Facilities, Myron Kuhlman, Society of Petroleum Engineers, Jun. 2000; pp. 1-14.
Monitoring Oil Shale Retorts by Off-Gas Alkene/Alkane Ratios, John H. Raley, Fuel, vol. 59, Jun. 1980, pp. 419-424.
The Shale Oil Question, Old and New Viewpoints, A Lecture in the Engineering Science Academy, Dr. Fredrik Ljungstrom, Feb. 23, 1950, published in Teknisk Trdskrift, Jan. 1951 p. 33-40.
Underground Shale Oil Pyrolysis According to the Ljungstroem Method; Svenska Skifferolje Aktiebolaget (Swedish Shale Oil Corp. ), IVA, vol. 24, 1953, No. 3, pp. 118-123.
Kinetics of Low-Temperature Pyrolysis of Oil Shale by the IITRI RF Process, Sresty et al.; 15th Oil Shale Symposium, Colorado School of Mines, Apr. 1982 pp. 1-13.
Bureau of Mines Oil-Shale Research, H.M. Thorne, Quarterly of the Colorado School of Mines, pp. 77-90, 1964.
Application of a Microretort to Problems in Shale Pyrolysis, A. W. Weitkamp & L.C. Gutberlet, Ind. Eng. Chem. Process Des. Develop. vol. 9, No. 3, 1970, pp. 386-395.
Oil Shale, Yen et al., Developments in Petroleum Science 5, 1976, pp. 187-189, 197-198.
The Composition of Green River Shale Oils, Glenn L. Cook, et al., United Nations Symposium on the Development and Utilization of Oil Shale Resources, 1968, pp. 1-23.
High-Pressure Pyrolysis of Green River Oil Shale, Burnham et al., Geochemistry and Chemistry of Oil Shales, American Chemical Society, 1983, pp. 335-351.
Geochemistry and Pyrolysis of Oil Shales, Tissot et al., Geochemistry and Chemistry of Oil Shales, American Chemical Society, 1983, pp. 1-11.
A Possible Mechanism of Alkene/Alkane Production, Burnham et al., Oil Shale, Tar Sands, and Related Materials, American Chemical Society, 1981, pp. 79-92.
The Ljungstroem In-Situ Method of Shale Oil Recovery, G. Salomonsson, Oil Shale and Cannel Coal, vol. 2, Proceedings of the Second Oil Shale and Cannel Coal Conference, Institute of Petroleum, 1951, London, pp. 260-280.
Developments in Technology for Green River Oil Shale, G.U. Dinneen, United Nations Symposium on the Development and Utilization of Oil Shale Resources, Laramie Petroleum Research Center, Bureau of Mines, 1968, pp. 1-20.
The Thermal and Structural Properties of a Hanna Basin Coal, R.E. Glass, Transactions of the ASME, vol. 106, Jun. 1984, pp. 266-271.
On the Mechanism of Kerogen Pyrolysis, Alan K. Burnham & James A. Happe, Jan. 10, 1984 (17 pages).
Comparison of Methods for Measuring Kerogen Pyrolysis Rates and Fitting Kinetic Parameters, Burnham et al., Mar. 23, 1987, (29 pages).
Further Comparison of Methods for Measuring Kerogen Pyrolysis Rates and Fitting Kinetic Parameters, Bumham et al., Sep. 1987, (16 pages).
Shale Oil Cracking Kinetics and Diagnostics, Bissell et al., Nov. 1983, (27 pages).
Mathematical Modeling of Modified in Situ and Aboveground Oil Shale Retorting, Robert L. Braun, Jan. 1981 (45 pages).
Progress Report on Computer Model for in Situ Oil Shale Retorting, R.L. Braun & R.C.Y. Chin, Jul. 14, 1977 (34 pages).
Chemical Kinetics and Oil Shale Process Design, Alan K. Burnham, Jul. 1993 (16 pages).
Reaction Kinetics and Diagnostics for Oil Shale Retorting, Alan K. Burnham, Oct. 19, 1981 (32 pages).
Reaction Kinetics Between Steam and Oil Shale Char, A.K. Burnham, Oct. 1978 (8 pages).
General Kinetic Model of Oil Shale Pyrolysis, Alan K. Burnham & Robert L. Braun, Dec. 1984 (25 pages).
U.S. Patent and Trademark Office, Office Communication for U.S. Appl. No. 12/757,621; mailed May 10, 2012.
U.S. Patent and Trademark Office, Office Communication for U.S. Appl. No. 12/757,621; mailed Oct. 24, 2012.
U.S. Patent and Trademark Office, Office Communication for U.S. Appl. No. 13/109,828; mailed Sep. 29, 2011.
U.S. Patent and Trademark Office, Office Communication for U.S. Appl. No. 13/109,828; mailed Mar. 27, 2012.
U.S. Patent and Trademark Office, Office Communication for U.S. Appl. No. 12/576,790; mailed Feb. 28, 2012.
U.S. Patent and Trademark Office, Office Communication for U.S. Appl. No. 12/757,621; mailed Apr. 8, 2013.
U.S. Patent and Trademark Office, Office Communication for U.S. Appl. No. 12/105,997; mailed Jun. 28, 2013.
U.S. Patent and Trademark Office, Office Communication for U.S. Appl. No. 12/757,621; mailed Jul. 1, 2013.
U.S. Patent and Trademark Office, Office Communication for U.S. Appl. No. 13/083,287; mailed Sep. 20, 2013.
U.S. Patent and Trademark "Office Communication" for U.S. Appl. No. 13/644,294, mailed Oct. 31, 2013.
U.S. Patent and Trademark Office, Office Communication for U.S. Appl. No. 12/105,974; mailed Dec. 6, 2013.
U.S. Patent and Trademark Office, Office Communication for U.S. Appl. No. 12/757,621; mailed Dec. 6, 2013.
U.S. Patent and Trademark Office, Office Communication for U.S. Appl. No. 13/083,257; mailed Mar. 7, 2014.
U.S. Patent and Trademark Office, Office Communication for U.S. Appl. No. 13/083,289; mailed Mar. 7, 2014.
United States Patent and Trademark "Office Communication" for U.S. Appl. No. 13/644,294, mailed Mar. 24, 2014.
U.S. Patent and Trademark "Office Communication" for U.S. Appl. No. 13/644,294, mailed May 23, 2014.
U.S. Patent and Trademark "Office Communication" for U.S. Appl. No. 13/644,294, mailed Jul. 25, 2014.
U.S. Patent and Trademark Office, Office Communication for U.S. Appl. No. 12/105,974; mailed Mar. 27, 2014.
U.S. Patent and Trademark Office, Office Communication for U.S. Appl. No. 12/105,974; mailed Jul. 10, 2014.
U.S. Patent and Trademark Office, Office Communication for U.S. Appl. No. 12/105,974; mailed Aug. 1, 2014.
U.S. Patent and Trademark Office, Office Communication for U.S. Appl. No. 12/757,621; mailed Mar. 10, 2013.
U.S. Patent and Trademark Office, Office Communication for U.S. Appl. No. 13/083,289; mailed Dec. 24, 2013.
U.S. Patent and Trademark Office, Office Communication for U.S. Appl. No. 13/083,289; mailed Sep. 10, 2014.
U.S. Patent and Trademark Office, Office Communication for U.S. Appl. No. 13/083,257; mailed Sep. 5, 2014.
U.S. Patent and Trademark Office, Office Communication for U.S. Appl. No. 13/083,287; mailed Jun. 30, 2014.
U.S. Patent and Trademark Office, Office Communication for U.S. Appl. No. 13/083,287; mailed Oct. 8, 2014.

* cited by examiner

FORMING BITUMEN BARRIERS IN SUBSURFACE HYDROCARBON FORMATIONS

PRIORITY CLAIM

This patent application claims priority to U.S. Provisional Patent No. 61/322,654 entitled "BARRIER METHODS FOR USE IN SUBSURFACE HYDROCARBON FORMATIONS" to Deeg et al. filed on Apr. 9, 2010; U.S. Provisional Patent No. 61/322,513 entitled "TREATMENT METHODOLOGIES FOR SUBSURFACE HYDROCARBON CONTAINING FORMATIONS" to Bass et al. filed on Apr. 9, 2010, U.S. Provisional Patent No. 61/391,389 entitled "BARRIER METHODS FOR USE IN SUBSURFACE HYDROCARBON FORMATIONS" to Deeg et al. filed Oct. 8, 2010; and International Patent Application No. PCT/US11/31559 entitled "FORMING BITUMEN BARRIERS IN SUBSURFACE HYDROCARBON FORMATIONS" to Karanikas et al. filed on Apr. 7, 2011, all of which are incorporated by reference in their entirety.

RELATED PATENTS

This patent application incorporates by reference in its entirety each of U.S. Pat. Nos. 6,688,387 to Wellington et al.; U.S. Pat. No. 6,991,036 to Sumnu-Dindoruk et al.; U.S. Pat. No. 6,698,515 to Karanikas et al.; U.S. Pat. No. 6,880,633 to Wellington et al.; U.S. Pat. No. 6,782,947 to de Rouffignac et al.; U.S. Pat. No. 6,991,045 to Vinegar et al.; U.S. Pat. No. 7,073,578 to Vinegar et al.; U.S. Pat. No. 7,121,342 to Vinegar et al.; U.S. Pat. No. 7,320,364 to Fairbanks; U.S. Pat. No. 7,527,094 to McKinzie et al.; U.S. Pat. No. 7,584,789 to Mo et al.; U.S. Pat. No. 7,533,719 to Hinson et al.; U.S. Pat. No. 7,562,707 to Miller; U.S. Pat. No. 7,841,408 to Vinegar et al.; U.S. Pat. No. 7,866,388 to Bravo; and U.S. Pat. No. 8,281,861 to Nguyen et al.; and U.S. Patent Application Publication No. 2010-0071903 to Prince-Wright et al.

BACKGROUND

1. Field of the Invention

The present invention relates generally to methods and systems for production of hydrocarbons, hydrogen, and/or other products from various subsurface formations such as hydrocarbon containing formations.

2. Description of Related Art

In situ processes may be used to treat subsurface formations. During some in situ processes, fluids may be introduced or generated in the formation. Introduced or generated fluids may need to be contained in a treatment area to minimize or eliminate impact of the in situ process on adjacent areas. During some in situ processes, a barrier may be formed around all or a portion of the treatment area to inhibit migration of fluids out of or into the treatment area.

A low temperature zone may be used to isolate selected areas of subsurface formation for many purposes. U.S. Pat. No. 7,032,660 to Vinegar et al.; U.S. Pat. No. 7,435,037 to McKinzie, II; U.S. Pat. No. 7,527,094 to McKinzie et al.; U.S. Pat. No. 7,500,528 to McKinzie, II et al.; U.S. Pat. No. 7,631,689 to Vinegar et al.; U.S. Pat. No. 7,841,401 to Kulhman et al.; and U.S. Pat. No. 7,703,513 to Vinegar et al., each of which is incorporated by reference as if fully set forth herein, describe barrier systems for subsurface treatment areas.

In some systems, ground is frozen to inhibit migration of fluids from a treatment area during soil remediation. U.S. Pat. No. 4,860,544 to Krieg et al.; U.S. Pat. No. 4,974,425 to Krieg et al.; U.S. Pat. No. 5,507,149 to Dash et al., U.S. Pat. No. 6,796,139 to Briley et al.; and U.S. Pat. No. 6,854,929 to Vinegar et al., each of which is incorporated by reference as if fully set forth herein, describe systems for freezing ground.

As discussed above, there has been a significant amount of effort to develop methods and systems to economically produce hydrocarbons, hydrogen, and/or other products from hydrocarbon containing formations. At present, however, there are still many hydrocarbon containing formations from which hydrocarbons, hydrogen, and/or other products cannot be economically produced. Thus, there is a need for improved methods and systems for heating of a hydrocarbon formation and production of fluids from the hydrocarbon formation. There is also a need for improved methods and systems that contain water and production fluids within a hydrocarbon treatment area.

SUMMARY

Embodiments described herein generally relate to systems and methods for treating a subsurface formation. In certain embodiments, the invention provides one or more systems and/or methods for treating a subsurface formation.

In certain embodiments, a method of forming a barrier in a formation includes: heating a portion of a formation adjacent to a plurality of wellbores to raise a temperature of the formation adjacent to the wellbores above a mobilization temperature of bitumen and below a pyrolysis temperature of hydrocarbons in the formation; and allowing the bitumen to move outwards from the wellbores towards a portion of the formation comprising water cooler than the mobilization temperature of the bitumen so that the bitumen solidifies in the formation to form a barrier.

In certain embodiments, a method of forming a barrier in a formation includes: assessing an amount of water in a first portion of a formation; providing a selected number of heater wellbores based on the amount of water in the first portion of the formation to a second portion of the formation; heating the second portion of a formation with the selected number of heater wellbores to raise a temperature of the formation adjacent to the wellbores above a mobilization temperature of bitumen and below a pyrolysis temperature of hydrocarbons in the formation; and allowing the bitumen to move outwards from the wellbores towards the first portion of the formation, wherein the water in the first portion is cooler than the mobilization temperature of the bitumen so that the bitumen solidifies in the formation to form a barrier between the first portion and the second portion.

In certain embodiments, a method of forming a barrier in a formation, includes heating a portion of a formation adjacent to a plurality of wellbores to raise a temperature of a portion of the formation adjacent to the wellbores above a mobilization temperature of bitumen and below a pyrolysis temperature of hydrocarbons in the formation; allowing the bitumen to move outwards from the wellbores towards a portion of the formation cooler than the mobilization temperature of the bitumen so that the bitumen solidifies in the formation to form a barrier; and forming a sealant layer between the barrier and the portion of the treatment area.

In further embodiments, features from specific embodiments may be combined with features from other embodiments. For example, features from one embodiment may be combined with features from any of the other embodiments.

In further embodiments, treating a subsurface formation is performed using any of the methods, systems, power supplies, or heaters described herein.

In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings.

Figure 1:
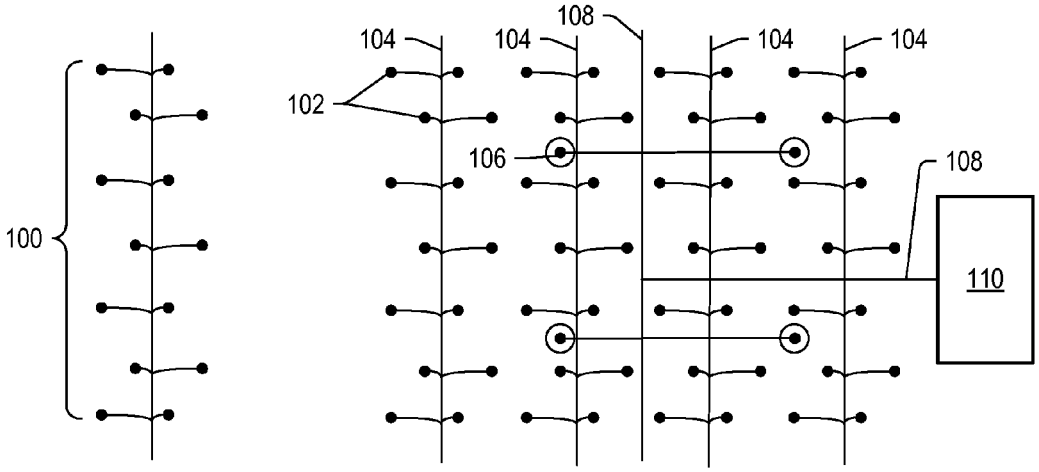
FIG. 1 shows a schematic view of an embodiment of a portion of an in situ heat treatment system for treating a hydrocarbon containing formation.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

The following description generally relates to systems and methods for treating hydrocarbons in the formations. Such formations may be treated to yield hydrocarbon products, hydrogen, and other products.

"API gravity" refers to API gravity at 15.5° C. (60° F.). API gravity is as determined by ASTM Method D6822 or ASTM Method D1298.

"ASTM" refers to ASTM International.

In the context of reduced heat output heating systems, apparatus, and methods, the term "automatically" means such systems, apparatus, and methods function in a certain way without the use of external control (for example, external controllers such as a controller with a temperature sensor and a feedback loop, PID controller, or predictive controller).

"Asphalt/bitumen" refers to a semi-solid, viscous material soluble in carbon disulfide. Asphalt/bitumen may be obtained from refining operations or produced from subsurface formations.

"Carbon number" refers to the number of carbon atoms in a molecule. A hydrocarbon fluid may include various hydrocarbons with different carbon numbers. The hydrocarbon fluid may be described by a carbon number distribution. Carbon numbers and/or carbon number distributions may be determined by true boiling point distribution and/or gas-liquid chromatography.

"Condensable hydrocarbons" are hydrocarbons that condense at 25° C. and one atmosphere absolute pressure. Condensable hydrocarbons may include a mixture of hydrocarbons having carbon numbers greater than 4. "Non-condensable hydrocarbons" are hydrocarbons that do not condense at 25° C. and one atmosphere absolute pressure. Non-condensable hydrocarbons may include hydrocarbons having carbon numbers less than 5.

A "fluid" may be, but is not limited to, a gas, a liquid, an emulsion, a slurry, and/or a stream of solid particles that has flow characteristics similar to liquid flow.

"Fluid injectivity" is the flow rate of fluids injected per unit of pressure differential between a first location and a second location.

"Fluid pressure" is a pressure generated by a fluid in a formation. "Lithostatic pressure" (sometimes referred to as "lithostatic stress") is a pressure in a formation equal to a weight per unit area of an overlying rock mass. "Hydrostatic pressure" is a pressure in a formation exerted by a column of water.

A "formation" includes one or more hydrocarbon containing layers, one or more non-hydrocarbon layers, an overburden, and/or an underburden. "Hydrocarbon layers" refer to layers in the formation that contain hydrocarbons. The hydrocarbon layers may contain non-hydrocarbon material and hydrocarbon material. The "overburden" and/or the "underburden" include one or more different types of impermeable materials. For example, the overburden and/or underburden may include rock, shale, mudstone, or wet/tight carbonate. In some embodiments of in situ heat treatment processes, the overburden and/or the underburden may include a hydrocarbon containing layer or hydrocarbon containing layers that are relatively impermeable and are not subjected to temperatures during in situ heat treatment processing that result in significant characteristic changes of the hydrocarbon containing layers of the overburden and/or the underburden. For example, the underburden may contain shale or mudstone, but the underburden is not allowed to heat to pyrolysis temperatures during the in situ heat treatment process. In some cases, the overburden and/or the underburden may be somewhat permeable.

"Formation fluids" refer to fluids present in a formation and may include pyrolyzation fluid, synthesis gas, mobilized hydrocarbons, and water (steam). Formation fluids may include hydrocarbon fluids as well as non-hydrocarbon fluids. The term "mobilized fluid" refers to fluids in a hydrocarbon containing formation that are able to flow as a result of thermal treatment of the formation. "Produced fluids" refer to fluids removed from the formation.

"Freezing point" of a hydrocarbon liquid refers to the temperature below which solid hydrocarbon crystals may form in the liquid. Freezing point is as determined by ASTM Method D5901.

A "heat source" is any system for providing heat to at least a portion of a formation substantially by conductive and/or radiative heat transfer. For example, a heat source may include electrically conducting materials and/or electric heaters such as an insulated conductor, an elongated member, and/or a conductor disposed in a conduit. A heat source may also include systems that generate heat by burning a fuel external to or in a formation. The systems may be surface burners, downhole gas burners, flameless distributed combustors, and natural distributed combustors. In some embodiments, heat provided to or generated in one or more heat sources is supplied by other sources of energy. The other sources of energy may directly heat a formation, or the energy may be applied to a transfer medium that directly or indirectly heats the formation. It is to be understood that one or more heat sources that are applying heat to a formation may use different sources of energy. Thus, for example, for a given formation some heat sources may supply heat from electrically conducting materials, electric resistance heaters, some heat sources may provide heat from combustion, and some heat sources may provide heat from one or more other energy sources (for example, chemical reactions, solar energy, wind energy, biomass, or other sources of renewable energy). A chemical reaction may include an exothermic reaction (for example, an oxidation reaction). A heat source may also include an electrically conducting material and/or a heater that provides heat to a zone proximate and/or surrounding a heating location such as a heater well.

A "heater" is any system or heat source for generating heat in a well or a near wellbore region. Heaters may be, but are not limited to, electric heaters, burners, combustors that react with material in or produced from a formation, and/or combinations thereof.

"Heavy hydrocarbons" are viscous hydrocarbon fluids. Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20°. Heavy oil, for example, generally has an API gravity of about 10-20°, whereas tar generally has an API gravity below about 10°. The viscosity of heavy hydrocarbons is generally greater than about 100 centipoise at 15° C. Heavy hydrocarbons may include aromatics or other complex ring hydrocarbons.

Heavy hydrocarbons may be found in a relatively permeable formation. The relatively permeable formation may include heavy hydrocarbons entrained in, for example, sand or carbonate. "Relatively permeable" is defined, with respect to formations or portions thereof, as an average permeability of 10 millidarcy or more (for example, 10 or 100 millidarcy). "Relatively low permeability" is defined, with respect to formations or portions thereof, as an average permeability of less than about 10 millidarcy. One darcy is equal to about 0.99 square micrometers. An impermeable layer generally has a permeability of less than about 0.1 millidarcy.

Certain types of formations that include heavy hydrocarbons may also include, but are not limited to, natural mineral waxes, or natural asphaltites. "Natural mineral waxes" typically occur in substantially tubular veins that may be several meters wide, several kilometers long, and hundreds of meters deep. "Natural asphaltites" include solid hydrocarbons of an aromatic composition and typically occur in large veins. In situ recovery of hydrocarbons from formations such as natural mineral waxes and natural asphaltites may include melting to form liquid hydrocarbons and/or solution mining of hydrocarbons from the formations.

"Hydrocarbons" are generally defined as molecules formed primarily by carbon and hydrogen atoms. Hydrocarbons may also include other elements such as, but not limited to, halogens, metallic elements, nitrogen, oxygen, and/or sulfur. Hydrocarbons may be, but are not limited to, kerogen, bitumen, pyrobitumen, oils, natural mineral waxes, and asphaltites. Hydrocarbons may be located in or adjacent to mineral matrices in the earth. Matrices may include, but are not limited to, sedimentary rock, sands, silicilytes, carbonates, diatomites, and other porous media. "Hydrocarbon fluids" are fluids that include hydrocarbons. Hydrocarbon fluids may include, entrain, or be entrained in non-hydrocarbon fluids such as hydrogen, nitrogen, carbon monoxide, carbon dioxide, hydrogen sulfide, water, and ammonia.

An "in situ conversion process" refers to a process of heating a hydrocarbon containing formation from heat sources to raise the temperature of at least a portion of the formation above a pyrolysis temperature so that pyrolyzation fluid is produced in the formation.

An "in situ heat treatment process" refers to a process of heating a hydrocarbon containing formation with heat sources to raise the temperature of at least a portion of the formation above a temperature that results in mobilized fluid, visbreaking, and/or pyrolysis of hydrocarbon containing material so that mobilized fluids, visbroken fluids, and/or pyrolyzation fluids are produced in the formation.

"Insulated conductor" refers to any elongated material that is able to conduct electricity and that is covered, in whole or in part, by an electrically insulating material.

"Kerogen" is a solid, insoluble hydrocarbon that has been converted by natural degradation and that principally contains carbon, hydrogen, nitrogen, oxygen, and sulfur. Coal and oil shale are typical examples of materials that contain kerogen. "Bitumen" is a non-crystalline solid or viscous hydrocarbon material that is substantially soluble in carbon disulfide. "Oil" is a fluid containing a mixture of condensable hydrocarbons.

"Olefins" are molecules that include unsaturated hydrocarbons having one or more non-aromatic carbon-carbon double bonds.

"Orifices" refer to openings, such as openings in conduits, having a wide variety of sizes and cross-sectional shapes including, but not limited to, circles, ovals, squares, rectangles, triangles, slits, or other regular or irregular shapes.

"Perforations" include openings, slits, apertures, or holes in a wall of a conduit, tubular, pipe or other flow pathway that allow flow into or out of the conduit, tubular, pipe or other flow pathway.

"Physical stability" refers to the ability of a formation fluid to not exhibit phase separation or flocculation during transportation of the fluid. Physical stability is determined by ASTM Method D7060.

"Pyrolysis" is the breaking of chemical bonds due to the application of heat. For example, pyrolysis may include transforming a compound into one or more other substances by heat alone. Heat may be transferred to a section of the formation to cause pyrolysis.

"Pyrolyzation fluids" or "pyrolysis products" refers to fluid produced substantially during pyrolysis of hydrocarbons. Fluid produced by pyrolysis reactions may mix with other fluids in a formation. The mixture would be considered pyrolyzation fluid or pyrolyzation product. As used herein, "pyrolysis zone" refers to a volume of a formation (for example, a relatively permeable formation such as a tar sands formation) that is reacted or reacting to form a pyrolyzation fluid.

"Residue" refers to hydrocarbons that have a boiling point above 537° C. (1000° F.).

"Subsidence" is a downward movement of a portion of a formation relative to an initial elevation of the surface.

"Superposition of heat" refers to providing heat from two or more heat sources to a selected section of a formation such that the temperature of the formation at least at one location between the heat sources is influenced by the heat sources.

"Synthesis gas" is a mixture including hydrogen and carbon monoxide. Additional components of synthesis gas may include water, carbon dioxide, nitrogen, methane, and other gases. Synthesis gas may be generated by a variety of processes and feedstocks. Synthesis gas may be used for synthesizing a wide range of compounds.

"Tar" is a viscous hydrocarbon that generally has a viscosity greater than about 10,000 centipoise at 15° C. The specific gravity of tar generally is greater than 1.000. Tar may have an API gravity less than 10°.

A "tar sands formation" is a formation in which hydrocarbons are predominantly present in the form of heavy hydrocarbons and/or tar entrained in a mineral grain framework or other host lithology (for example, sand or carbonate). Examples of tar sands formations include formations such as the Athabasca formation, the Grosmont formation, and the Peace River formation, all three in Alberta, Canada; and the Faja formation in the Orinoco belt in Venezuela.

"Temperature limited heater" generally refers to a heater that regulates heat output (for example, reduces heat output) above a specified temperature without the use of external controls such as temperature controllers, power regulators, rectifiers, or other devices. Temperature limited heaters may be AC (alternating current) or modulated (for example, "chopped") DC (direct current) powered electrical resistance heaters.

"Thermal fracture" refers to fractures created in a formation caused by expansion or contraction of a formation and/or fluids in the formation, which is in turn caused by increasing/decreasing the temperature of the formation and/or fluids in the formation, and/or by increasing/decreasing a pressure of fluids in the formation due to heating.

"Thickness" of a layer refers to the thickness of a cross section of the layer, wherein the cross section is normal to a face of the layer.

A "u-shaped wellbore" refers to a wellbore that extends from a first opening in the formation, through at least a portion of the formation, and out through a second opening in the formation. In this context, the wellbore may be only roughly in the shape of a "v" or "u", with the understanding that the "legs" of the "u" do not need to be parallel to each other, or perpendicular to the "bottom" of the "u" for the wellbore to be considered "u-shaped".

"Upgrade" refers to increasing the quality of hydrocarbons. For example, upgrading heavy hydrocarbons may result in an increase in the API gravity of the heavy hydrocarbons.

"Visbreaking" refers to the untangling of molecules in fluid during heat treatment and/or to the breaking of large molecules into smaller molecules during heat treatment, which results in a reduction of the viscosity of the fluid.

"Viscosity" refers to kinematic viscosity at 40° C. unless otherwise specified. Viscosity is as determined by ASTM Method D445.

"Wax" refers to a low melting organic mixture, or a compound of high molecular weight that is a solid at lower temperatures and a liquid at higher temperatures, and when in solid form can form a barrier to water. Examples of waxes include animal waxes, vegetable waxes, mineral waxes, petroleum waxes, and synthetic waxes.

The term "wellbore" refers to a hole in a formation made by drilling or insertion of a conduit into the formation. A wellbore may have a substantially circular cross section, or another cross-sectional shape. As used herein, the terms "well" and "opening," when referring to an opening in the formation may be used interchangeably with the term "wellbore."

Methods and systems for production and storage of hydrocarbons, hydrogen, carbon dioxide and/or other products from various subsurface formations such as hydrocarbon containing formations, or other desired formations that are used as an in situ storage sites.

A formation may be treated in various ways to produce many different products. Different stages or processes may be used to treat the formation during an in situ heat treatment process. In some embodiments, one or more sections of the formation are solution mined to remove soluble minerals from the sections. Solution mining minerals may be performed before, during, and/or after the in situ heat treatment process. In some embodiments, the average temperature of one or more sections being solution mined is maintained below about 120° C.

In some embodiments, one or more sections of the formation are heated to remove water from the sections and/or to remove methane and other volatile hydrocarbons from the sections. In some embodiments, the average temperature is raised from ambient temperature to temperatures below about 220° C. during removal of water and volatile hydrocarbons.

In some embodiments, one or more sections of the formation are heated to temperatures that allow for movement and/or visbreaking of hydrocarbons in the formation. In some embodiments, the average temperature of one or more sections of the formation are raised to mobilization temperatures of hydrocarbons in the sections (for example, to temperatures ranging from 100° C. to 250° C., from 120° C. to 240° C., or from 150° C. to 230° C.).

In some embodiments, one or more sections are heated to temperatures that allow for pyrolysis reactions in the formation. In some embodiments, the average temperature of one or more sections of the formation is raised to pyrolysis temperatures of hydrocarbons in the sections (for example, temperatures ranging from 230° C. to 900° C., from 240° C. to 400° C. or from 250° C. to 350° C.).

Heating the hydrocarbon containing formation with a plurality of heat sources may establish thermal gradients around the heat sources that raise the temperature of hydrocarbons in the formation to desired temperatures at desired heating rates. The rate of temperature increase through the mobilization temperature range and/or the pyrolysis temperature range for desired products may affect the quality and quantity of the formation fluids produced from the hydrocarbon containing formation. Slowly raising the temperature of the formation through the mobilization temperature range and/or pyrolysis temperature range may allow for the production of high quality, high API gravity hydrocarbons from the formation. Slowly raising the temperature of the formation through the mobilization temperature range and/or pyrolysis temperature range may allow for the removal of a large amount of the hydrocarbons present in the formation as hydrocarbon product.

In some in situ heat treatment embodiments, a portion of the formation is heated to a desired temperature instead of slowly raising the temperature through a temperature range. In some embodiments, the desired temperature is 300° C., 325° C., or 350° C. Other temperatures may be selected as the desired temperature.

Superposition of heat from heat sources allows the desired temperature to be relatively quickly and efficiently established in the formation. Energy input into the formation from the heat sources may be adjusted to maintain the temperature in the formation substantially at a desired temperature.

Mobilization and/or pyrolysis products may be produced from the formation through production wells. In some embodiments, the average temperature of one or more sections is raised to mobilization temperatures and hydrocarbons are produced from the production wells. The average temperature of one or more of the sections may be raised to pyrolysis temperatures after production due to mobilization decreases below a selected value. In some embodiments, the average temperature of one or more sections is raised to pyrolysis temperatures without significant production before reaching pyrolysis temperatures. Formation fluids including pyrolysis products may be produced through the production wells.

In some embodiments, the average temperature of one or more sections is raised to temperatures sufficient to allow synthesis gas production after mobilization and/or pyrolysis. In some embodiments, a temperature of hydrocarbons is raised to temperatures sufficient to allow synthesis gas production without significant production before reaching the temperatures sufficient to allow synthesis gas production. For example, synthesis gas may be produced in a temperature range from about 400° C. to about 1200° C., about 500° C. to about 1100° C., or about 550° C. to about 1000° C. A synthesis gas generating fluid (for example, steam and/or water) may be introduced into the sections to generate synthesis gas. Synthesis gas may be produced from production wells.

Solution mining, removal of volatile hydrocarbons and water, mobilizing hydrocarbons, pyrolyzing hydrocarbons, generating synthesis gas, and/or other processes may be performed during the in situ heat treatment process. In some embodiments, some processes are performed after the in situ heat treatment process. Such processes may include, but are not limited to, recovering heat from treated sections, storing fluids (for example, water and/or hydrocarbons) in previously treated sections, and/or sequestering carbon dioxide in previously treated sections.

FIG. 1 depicts a schematic view of an embodiment of a portion of the in situ heat treatment system for treating the hydrocarbon containing formation. The in situ heat treatment system may include barrier wells 100. Barrier wells are used to form a barrier around a treatment area. The barrier inhibits fluid flow into and/or out of the treatment area. Barrier wells include, but are not limited to, dewatering wells, vacuum wells, capture wells, injection wells, grout wells, freeze wells, or combinations thereof. In some embodiments, barrier wells 100 are dewatering wells. Dewatering wells may remove liquid water and/or inhibit liquid water from entering a portion of the formation to be heated, or to the formation being heated. In the embodiment depicted in FIG. 1, the barrier wells 100 are shown extending only along one side of heat sources 102, but the barrier wells typically encircle all heat sources 102 used, or to be used, to heat a treatment area of the formation.

In certain embodiments, a barrier may be formed in the formation after a solution mining process and/or an in situ heat treatment process by introducing a fluid into the formation. The barrier may inhibit formation fluid from entering the treatment area after the solution mining and/or the in situ heat treatment processes have ended. The barrier formed by introducing fluid into the formation may allow for isolation of the treatment area.

The fluid introduced into the formation to form the barrier may include wax, bitumen, heavy oil, sulfur, polymer, gel, saturated saline solution, and/or one or more reactants that react to form a precipitate, solid, or high viscosity fluid in the formation. In some embodiments, bitumen, heavy oil, reactants, and/or sulfur used to form the barrier are obtained from treatment facilities associated with the in situ heat treatment process. For example, sulfur may be obtained from a Claus process used to treat produced gases to remove hydrogen sulfide and other sulfur compounds.

The fluid may be introduced into the formation as a liquid, vapor, or mixed phase fluid. The fluid may be introduced into a portion of the formation that is at an elevated temperature. In some embodiments, the fluid is introduced into the formation through wells located near a perimeter of the treatment area. The fluid may be directed away from the interior of the treatment area. The elevated temperature of the formation maintains or allows the fluid to have a low viscosity such that the fluid moves away from the wells. At least a portion of the fluid may spread outwards in the formation towards a cooler portion of the formation. The relatively high permeability of the formation allows fluid introduced from one wellbore to spread and mix with fluid introduced from at least one other wellbore. In the cooler portion of the formation, the viscosity of the fluid increases, a portion of the fluid precipitates, and/or the fluid solidifies or thickens such that the fluid forms the barrier that inhibits flow of formation fluid into or out of the treatment area.

Heat sources 102 are placed in at least a portion of the formation. Heat sources 102 may include heaters such as insulated conductors, conductor-in-conduit heaters, surface burners, flameless distributed combustors, and/or natural distributed combustors. Heat sources 102 may also include other types of heaters. Heat sources 102 provide heat to at least a portion of the formation to heat hydrocarbons in the formation. Energy may be supplied to heat sources 102 through supply lines 104. Supply lines 104 may be structurally different depending on the type of heat source or heat sources used to heat the formation. Supply lines 104 for heat sources may transmit electricity for electric heaters, may transport fuel for combustors, or may transport heat exchange fluid that is circulated in the formation. In some embodiments, electricity for an in situ heat treatment process is provided by a nuclear power plant or nuclear power plants. The use of nuclear power may allow for reduction or elimination of carbon dioxide emissions from the in situ heat treatment process.

When the formation is heated, the heat input into the formation may cause expansion of the formation and geomechanical motion. The heat sources may be turned on before, at the same time, or during a dewatering process. Computer simulations may model formation response to heating. The computer simulations may be used to develop a pattern and time sequence for activating heat sources in the formation so that geomechanical motion of the formation does not adversely affect the functionality of heat sources, production wells, and other equipment in the formation.

Heating the formation may cause an increase in permeability and/or porosity of the formation. Increases in permeability and/or porosity may result from a reduction of mass in the formation due to vaporization and removal of water, removal of hydrocarbons, and/or creation of fractures. Fluid may flow more easily in the heated portion of the formation because of the increased permeability and/or porosity of the formation. Fluid in the heated portion of the formation may move a considerable distance through the formation because of the increased permeability and/or porosity. The considerable distance may be over 1000 m depending on various factors, such as permeability of the formation, properties of the fluid, temperature of the formation, and pressure gradient allowing movement of the fluid. The ability of fluid to travel considerable distance in the formation allows production wells 106 to be spaced relatively far apart in the formation.

Production wells 106 are used to remove formation fluid from the formation. In some embodiments, production well 106 includes a heat source. The heat source in the production well may heat one or more portions of the formation at or near the production well. In some in situ heat treatment process embodiments, the amount of heat supplied to the formation from the production well per meter of the production well is less than the amount of heat applied to the formation from a heat source that heats the formation per meter of the heat source. Heat applied to the formation from the production well may increase formation permeability adjacent to the production well by vaporizing and removing liquid phase fluid adjacent to the production well and/or by increasing the permeability of the formation adjacent to the production well by formation of macro and/or micro fractures.

More than one heat source may be positioned in the production well. A heat source in a lower portion of the production well may be turned off when superposition of heat from adjacent heat sources heats the formation sufficiently to counteract benefits provided by heating the formation with the production well. In some embodiments, the heat source in an upper portion of the production well remains on after the heat source in the lower portion of the production well is deactivated. The heat source in the upper portion of the well may inhibit condensation and reflux of formation fluid.

In some embodiments, the heat source in production well 106 allows for vapor phase removal of formation fluids from the formation. Providing heating at or through the production well may: (1) inhibit condensation and/or refluxing of production fluid when such production fluid is moving in the production well proximate the overburden, (2) increase heat input into the formation, (3) increase production rate from the production well as compared to a production well without a heat source, (4) inhibit condensation of high carbon number compounds ($C_6$ hydrocarbons and above) in the production well, and/or (5) increase formation permeability at or proximate the production well.

Subsurface pressure in the formation may correspond to the fluid pressure generated in the formation. As temperatures in the heated portion of the formation increase, the pressure in the heated portion may increase as a result of thermal expansion of in situ fluids, increased fluid generation and vaporization of water. Controlling a rate of fluid removal from the formation may allow for control of pressure in the formation. Pressure in the formation may be determined at a number of different locations, such as near or at production wells, near or at heat sources, or near or at monitor wells.

In some hydrocarbon containing formations, production of hydrocarbons from the formation is inhibited until at least some hydrocarbons in the formation have been mobilized and/or pyrolyzed. Formation fluid may be produced from the formation when the formation fluid is of a selected quality. In some embodiments, the selected quality includes an API gravity of at least about 20°, 30°, or 40° Inhibiting production until at least some hydrocarbons are mobilized and/or pyrolyzed may increase conversion of heavy hydrocarbons to light hydrocarbons. Inhibiting initial production may minimize the production of heavy hydrocarbons from the formation. Production of substantial amounts of heavy hydrocarbons may require expensive equipment and/or reduce the life of production equipment.

In some hydrocarbon containing formations, hydrocarbons in the formation may be heated to mobilization and/or pyrolysis temperatures before substantial permeability has been generated in the heated portion of the formation. An initial lack of permeability may inhibit the transport of generated fluids to production wells 106. During initial heating, fluid pressure in the formation may increase proximate heat sources 102. The increased fluid pressure may be released, monitored, altered, and/or controlled through one or more heat sources 102. For example, selected heat sources 102 or separate pressure relief wells may include pressure relief valves that allow for removal of some fluid from the formation.

In some embodiments, pressure generated by expansion of mobilized fluids, pyrolysis fluids or other fluids generated in the formation is allowed to increase although an open path to production wells 106 or any other pressure sink may not yet exist in the formation. The fluid pressure may be allowed to increase towards a lithostatic pressure. Fractures in the hydrocarbon containing formation may form when the fluid approaches the lithostatic pressure. For example, fractures may form from heat sources 102 to production wells 106 in the heated portion of the formation. The generation of fractures in the heated portion may relieve some of the pressure in the portion. Pressure in the formation may have to be maintained below a selected pressure to inhibit unwanted production, fracturing of the overburden or underburden, and/or coking of hydrocarbons in the formation.

After mobilization and/or pyrolysis temperatures are reached and production from the formation is allowed, pressure in the formation may be varied to alter and/or control a composition of formation fluid produced, to control a percentage of condensable fluid as compared to non-condensable fluid in the formation fluid, and/or to control an API gravity of formation fluid being produced. For example, decreasing pressure may result in production of a larger condensable fluid component. The condensable fluid component may contain a larger percentage of olefins.

In some in situ heat treatment process embodiments, pressure in the formation may be maintained high enough to promote production of formation fluid with an API gravity of greater than 20°. Maintaining increased pressure in the formation may inhibit formation subsidence during in situ heat treatment. Maintaining increased pressure may reduce or eliminate the need to compress formation fluids at the surface to transport the fluids in collection conduits to treatment facilities.

Maintaining increased pressure in a heated portion of the formation may surprisingly allow for production of large quantities of hydrocarbons of increased quality and of relatively low molecular weight. Pressure may be maintained so that formation fluid produced has a minimal amount of compounds above a selected carbon number. The selected carbon number may be at most 25, at most 20, at most 12, or at most 8. Some high carbon number compounds may be entrained in vapor in the formation and may be removed from the formation with the vapor. Maintaining increased pressure in the formation may inhibit entrainment of high carbon number compounds and/or multi-ring hydrocarbon compounds in the vapor. High carbon number compounds and/or multi-ring hydrocarbon compounds may remain in a liquid phase in the formation for significant time periods. The significant time periods may provide sufficient time for the compounds to pyrolyze to form lower carbon number compounds.

Generation of relatively low molecular weight hydrocarbons is believed to be due, in part, to autogenous generation and reaction of hydrogen in a portion of the hydrocarbon containing formation. For example, maintaining an increased pressure may force hydrogen generated during pyrolysis into the liquid phase within the formation. Heating the portion to a temperature in a pyrolysis temperature range may pyrolyze hydrocarbons in the formation to generate liquid phase pyrolyzation fluids. The generated liquid phase pyrolyzation fluids components may include double bonds and/or radicals. Hydrogen ($H_2$) in the liquid phase may reduce double bonds of the generated pyrolyzation fluids, thereby reducing a potential for polymerization or formation of long chain compounds from the generated pyrolyzation fluids. In addition, $H_2$ may also neutralize radicals in the generated pyrolyzation fluids. $H_2$ in the liquid phase may inhibit the generated pyrolyzation fluids from reacting with each other and/or with other compounds in the formation.

Formation fluid produced from production wells 106 may be transported through collection piping 108 to treatment facilities 110. Formation fluids may also be produced from heat sources 102. For example, fluid may be produced from heat sources 102 to control pressure in the formation adjacent to the heat sources. Fluid produced from heat sources 102 may be transported through tubing or piping to collection piping 108 or the produced fluid may be transported through tubing or piping directly to treatment facilities 110. Treatment facilities 110 may include separation units, reaction units, upgrading units, fuel cells, turbines, storage vessels, and/or other systems and units for processing produced formation fluids. The treatment facilities may form transportation fuel from at least a portion of the hydrocarbons produced from the formation. In some embodiments, the transportation fuel is jet fuel, such as JP-8.

To form a low temperature barrier, spaced apart wellbores may be formed in the formation where the barrier is to be formed. Piping may be placed in the wellbores. A low temperature heat transfer fluid may be circulated through the piping to reduce the temperature adjacent to the wellbores. The low temperature zone around the wellbores may expand outward. Eventually the low temperature zones produced by two adjacent wellbores merge. The temperature of the low temperature zones may be sufficiently low to freeze formation fluid so that a substantially impermeable barrier is formed. The wellbore spacing may be from about 1 m to 3 m or more.

Wellbore spacing may be a function of a number of factors, including formation composition and properties, formation fluid and properties, time available for forming the barrier, and temperature and properties of the low temperature heat transfer fluid. In general, a very cold temperature of the low temperature heat transfer fluid allows for a larger spacing and/or for quicker formation of the barrier. A very cold temperature may be −20° C. or less.

In some embodiments, a double barrier system is used to isolate a treatment area. The double barrier system may be formed with a first barrier and a second barrier. The first barrier may be formed around at least a portion of the treatment area to inhibit fluid from entering or exiting the treatment area. The second barrier may be formed around at least a portion of the first barrier to isolate an inter-barrier zone between the first barrier and the second barrier. The double barrier system may allow greater formation depths than a single barrier system. Greater depths are possible with the double barrier system because the stepped differential pressures across the first barrier and the second barrier is less than the differential pressure across a single barrier. The smaller differential pressures across the first barrier and the second barrier make a breach of the double barrier system less likely to occur at depth for the double barrier system as compared to the single barrier system.

The double barrier system reduces the probability that a barrier breach will affect the treatment area or the formation on the outside of the double barrier. That is, the probability that the location and/or time of occurrence of the breach in the first barrier will coincide with the location and/or time of occurrence of the breach in the second barrier is low, especially if the distance between the first barrier and the second barrier is relatively large (for example, greater than about 15 m). Having a double barrier may reduce or eliminate influx of fluid into the treatment area following a breach of the first barrier or the second barrier. The treatment area may not be affected if the second barrier breaches. If the first barrier breaches, only a portion of the fluid in the inter-barrier zone is able to enter the contained zone. Also, fluid from the contained zone will not pass the second barrier. Recovery from a breach of a barrier of the double barrier system may require less time and fewer resources than recovery from a breach of a single barrier system. For example, reheating a treatment area zone following a breach of a double barrier system may require less energy than reheating a similarly sized treatment area zone following a breach of a single barrier system.

The first barrier and the second barrier may be the same type of barrier or different types of barriers. In some embodiments, the first barrier and the second barrier are formed by freeze wells. In some embodiments, the first barrier is formed by freeze wells, and the second barrier is a grout wall. The grout wall may be formed of cement, sulfur, sulfur cement, or combinations thereof (for example, fine cement and micro fine cement). In some embodiments, a portion of the first barrier and/or a portion of the second barrier is a natural barrier, such as an impermeable rock formation.

Grout, wax, polymer or other material may be used in combination with freeze wells to provide a barrier for the in situ heat treatment process. The material may fill cavities in the formation and reduces the permeability of the formation. The material may have higher thermal conductivity than gas and/or formation fluid that fills cavities in the formation. Placing material in the cavities may allow for faster low temperature zone formation. The material may form a perpetual barrier in the formation that may strengthen the formation. The use of material to form the barrier in unconsolidated or substantially unconsolidated formation material may allow for larger well spacing than is possible without the use of the material. The combination of the material and the low temperature zone formed by freeze wells may constitute a double barrier for environmental regulation purposes. In some embodiments, the material is introduced into the formation as a liquid, and the liquid sets in the formation to form a solid. The material may be, but is not limited to, fine cement, micro fine cement, sulfur, sulfur cement, viscous thermoplastics, and/or waxes. The material may include surfactants, stabilizers or other chemicals that modify the properties of the material. For example, the presence of surfactant in the material may promote entry of the material into small openings in the formation.

Material may be introduced into the formation through freeze well wellbores. The material may be allowed to set. The integrity of the wall formed by the material may be checked. The integrity of the material wall may be checked by logging techniques and/or by hydrostatic testing. If the permeability of a section formed by the material is too high, additional material may be introduced into the formation through freeze well wellbores. After the permeability of the section is sufficiently reduced, freeze wells may be installed in the freeze well wellbores.

Material may be injected into the formation at a pressure that is high, but below the fracture pressure of the formation. In some embodiments, injection of material is performed in 16 m increments in the freeze wellbore. Larger or smaller increments may be used if desired. In some embodiments, material is only applied to certain portions of the formation. For example, material may be applied to the formation through the freeze wellbore only adjacent to aquifer zones and/or to relatively high permeability zones (for example, zones with a permeability greater than about 0.1 darcy). Applying material to aquifers may inhibit migration of water from one aquifer to a different aquifer. For material placed in the formation through freeze well wellbores, the material may inhibit water migration between aquifers during formation of the low temperature zone. The material may also inhibit water migration between aquifers when an established low temperature zone is allowed to thaw.

In certain embodiments, portions of a formation where a barrier is to be installed may be intentionally fractured. The portions which are to be fractured may be subjected to a pressure which is above the formation fracturing pressure but below the overburden fracture pressure. For example, steam may be injected through one or more injection/production wells above the formation fracturing pressure which may increase the permeability. In some embodiments, one or more gas pressure pulses is used to fracture portions of the formation. Fractured portion surrounding the wellbores may allow materials used to create barriers to permeate through the formation more readily.

In some embodiments, if the upper layer (the overburden) or the lower layer (the underburden) of the formation is likely to allow fluid flow into the treatment area or out of the treatment area, horizontally positioned freeze wells may be used to form an upper and/or a lower barrier for the treatment area. In some embodiments, an upper barrier and/or a lower barrier may not be necessary if the upper layer and/or the lower layer are at least substantially impermeable. If the upper freeze barrier is formed, portions of heat sources, production wells, injection wells, and/or dewatering wells that pass through the low temperature zone created by the freeze wells forming the upper freeze barrier wells may be insulated and/or heat traced so that the low temperature zone does not adversely affect the functioning of the heat sources, production wells, injection wells and/or dewatering wells passing through the low temperature zone.

In some embodiments, one or both barriers is formed from wellbores positioned in the formation. The position of the wellbores used to form the second barrier may be adjusted relative to the wellbores used to form the first barrier to limit a separation distance between a breach, or portion of the barrier that is difficult to form, and the nearest wellbore. For example, if freeze wells are used to form both barriers of a double barrier system, the position of the freeze wells may be adjusted to facilitate formation of the barriers and limit the distance between a potential breach and the closest wells to the breach. Adjusting the position of the wells of the second barrier relative to the wells of the first barrier may also be used when one or more of the barriers are barriers other than freeze barriers (for example, dewatering wells, cement barriers, grout barriers, and/or wax barriers).

In some embodiments, wellbores for forming the first barrier are formed in a row in the formation. During formation of the wellbores, logging techniques and/or analysis of cores may be used to determine the principal fracture direction and/or the direction of water flow in one or more layers of the formation. In some embodiments, two or more layers of the formation have different principal fracture directions and/or the directions of water flow that need to be addressed. In such formations, three or more barriers may need to be formed in the formation to allow for formation of the barriers that inhibit inflow of formation fluid into the treatment area or outflow of formation fluid from the treatment area. Barriers may be formed to isolate particular layers in the formation.

The principal fracture direction and/or the direction of water flow may be used to determine the placement of wells used to form the second barrier relative to the wells used to form the first barrier. The placement of the wells may facilitate formation of the first barrier and the second barrier.

As discussed, there are several benefits to employing a double barrier system to isolate a treatment area. Freeze wells may be used to form the first barrier and/or the second barrier. Problems may arise when freeze wells are used to form one or more barriers of a double barrier system. For example, a first barrier formed from freeze wells may expand further than is desirable. The first barrier may expand to a point such that the first barrier merges with a second barrier for a single barrier. Upon formation of a single barrier advantages associated with a double barrier may be lost. It would be beneficial to inhibit one or more portions of the first barrier and second barrier from forming a single combined barrier.

In some embodiments, a double barrier system includes a system which functions, during use, to inhibit one or more portions of the first barrier and second barrier from forming a single combined barrier. In some embodiments, the system includes an injection system. The injection system may inject one or more materials in the space which exists between the first barrier and the second barrier. The material may inhibit one or more portions of the first barrier and second barrier from forming a single combined barrier. Typically, the material may include one or more fluids which inhibit freezing of water and/or any other fluids in the space between the first barrier and the second barrier. The fluids may be heated to further inhibit expansion of one or more of the barriers. The fluids may be heated as a result of processes related to the in situ heat treatment of hydrocarbons in the treatment area defined by the barriers and/or in situ heat treatment processes occurring in other portions of the hydrocarbon containing formation.

In some embodiments, the system circulates fluids through the space which exists between the first barrier and the second barrier. For example, fluids may be provided through at least a first wellbore in a first portion of the space and removed through at least a second wellbore in a second portion of the space. The wellbores may serve multiple purposes (for example, heating, production, and/or injection). The fluids circulating through the space may be cooled by the barriers. Cooled fluids which are removed from the space between the barriers may be used for processes related to the in situ heat treatment of hydrocarbons in the treatment area defined by the barriers and/or in situ heat treatment processes occurring in other portions of the hydrocarbon containing formation. In some embodiments, the fluids are recirculated through the space between the barriers, therefore, the system may include a subsystem on the surface for reheating fluids before they are re-injected through the first wellbore.

In some embodiments, fluids include water. Providing fluid to the space between the first barrier and second barrier may inhibit the two barriers from combining with one another. Fluid injected in the space may be available from processes related to the in situ heat treatment of hydrocarbons in the treatment area defined by the barriers and/or in situ heat treatment processes occurring in other portions of the hydrocarbon containing formation. Water is a commonly available fluid in certain parts of the world and using local sources of water for injection reduces costs (for example, costs associated with transportation). Water from local sources adjacent the treatment area may be employed for injection in the space.

In some embodiments, local sources of water are natural sources of water or at least result from natural sources. When water from local sources is used, fluctuation in availability of such sources must be taken into consideration. Natural sources of water may be subject to seasonal changes of availability. For example, when treatment areas are adjacent to mountainous regions, runoff water from melting snows may be employed. Local water sources including, but not limited to, seasonal water sources, may be used for in situ heat treatment processes. For example, inhibiting one or more portions of the first barrier and second barrier from forming a single combined barrier by providing the water from seasonal water sources in the space between the barriers In some embodiments, injected fluids include additives. Additives may include other fluids, solid materials which may or may not dissolve in the injected fluids. Additives may serve a variety of different purposes. For example, additives may function to decrease the freezing point of the fluid used below its naturally occurring freeze point without any additives. An example of a fluid with additives capable of reducing the fluids freezing point may include water with salt dissolved in the water. Water is an inexpensive and commonly available fluid whose properties are well known; however, forming frozen barriers using water as a circulating fluid to inhibit merging of multiple barriers may be potentially problematic. Frozen barriers are by definition cold enough to potentially freeze any water circulated through the space between the barriers, potentially contributing to the problem of merging barriers. Salt is a relatively inexpensive and commonly available material which is soluble in water and reduces the freezing point of water. Providing salt to the water that is being circulated in the space between the barriers may inhibit the barriers from merging.

In some embodiments, heat is provided to the space between barriers. Providing heat to the space between two barriers may inhibit the barriers from merging with one another. A plurality of heater wells may be positioned in the space between the barriers. The number of heater wells required may be dependent on several factors (for example, the dimensions of the space between the barriers, the materials forming the space between the barriers, the type of heaters used, or combinations thereof). Heat provided by the heater wells positioned between barrier wells may inhibit the barriers from merging without endangering the structural integrity of the barriers.

In some embodiments, combinations of different strategies to inhibit the merging of barriers are employed. For example, fluids may be circulated through the space between barriers while, at the same time, using heater wells to heat the space.

Figure 2:
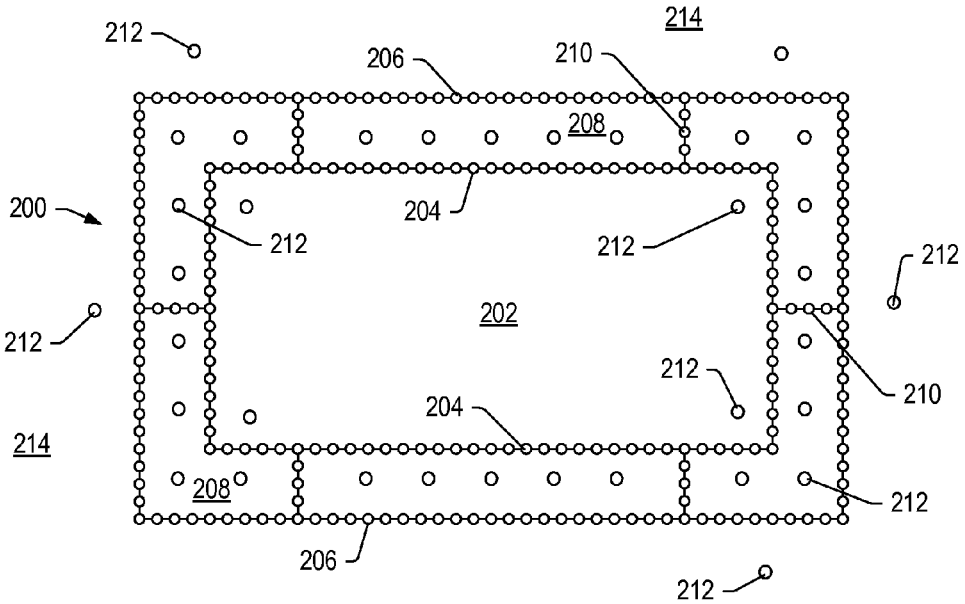
FIG. 2 depicts a schematic representation of an embodiment of a dual barrier system.

FIG. 2 depicts an embodiment of double barrier system 200. The perimeter of treatment area 202 may be surrounded by first barrier 204. First barrier 204 may be surrounded by second barrier 206. Inter-barrier zones 208 may be isolated between first barrier 204, second barrier 206 and partitions 210. Creating sections with partitions 210 between first barrier 204 and second barrier 206 limits the amount of fluid held in individual inter-barrier zones 208. Partitions 210 may strengthen double barrier system 200. In some embodiments, the double barrier system may not include partitions.

The inter-barrier zone may have a thickness from about 1 m to about 300 m. In some embodiments, the thickness of the inter-barrier zone is from about 10 m to about 100 m, or from about 20 m to about 50 m.

Pumping/monitor wells 212 may be positioned in treatment area 202, inter-barrier zones 208, and/or outer zone 214 outside of second barrier 206. Pumping/monitor wells 212 allow for removal of fluid from treatment area 202, inter-barrier zones 208, or outer zone 214. Pumping/monitor wells 212 also allow for monitoring of fluid levels in treatment area 202, inter-barrier zones 208, and outer zone 214. Pumping/monitor wells 212 positioned in inter-barrier zones 208 may be used to inject and/or circulate fluids to inhibit merging of first barrier 204 and second barrier 206.

In some embodiments, a portion of treatment area 202 is heated by heat sources. The closest heat sources to first barrier 204 may be installed a desired distance away from the first barrier. In some embodiments, the desired distance between the closest heat sources and first barrier 204 is in a range between about 5 m and about 300 m, between about 10 m and about 200 m, or between about 15 m and about 50 m. For example, the desired distance between the closest heat sources and first barrier 204 may be about 40 m.

FIG. 2 depicts only one embodiment of how a barrier using freeze wells may be laid out. The barrier surrounding the treatment area may be arranged in any number of shapes and configurations. Different configurations may result in the barrier having different properties and advantages (and/or disadvantages). Different formations may benefit from different barrier configurations. Forming a barrier in a formation where water within the formation does not flow much may require less planning relative to another formation where large volumes of water move underground rapidly. Large volumes of relatively rapidly moving water through a formation may create excessive amounts of pressure against a formed barrier and consequently increase the difficulty in initially forming the barrier. Changing a shape of a perimeter of the barrier may reduce the pressures exerted by such exterior (relative to the interior treatment area) formation water flows, and thus increasing the structural stability of the barrier.

In some embodiments, a barrier may be oriented at an angle (for example, a 45 degree angle) relative to a direction of a flow of water in a formation. Forming the barrier at an angle may reduce the pressure of the water exerted on the exterior of the barrier. Large volumes of relatively rapidly moving water through a formation may create excessive amounts of pressure therefore increasing the difficulty in initially forming the barrier. Several strategies may be employed to form the barrier under the increased pressures exerted by flowing water.

Figure 3:
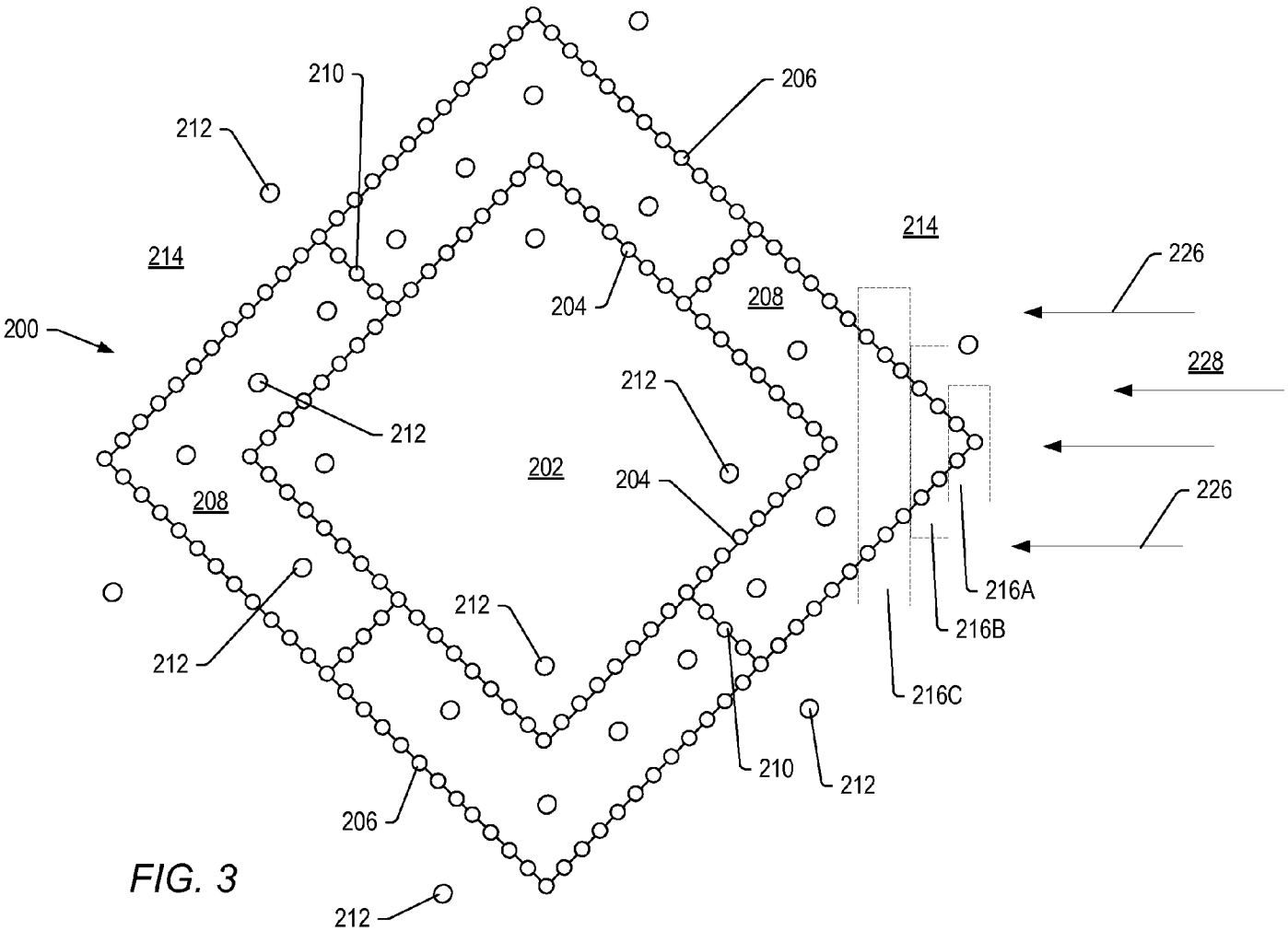
FIG. 3 depicts a schematic representation of another embodiment of a dual barrier system.

A barrier may be formed using freeze wells arranged oriented at an angle relative to a direction of a flow of water in a formation. In some embodiments, freeze wells are activated sequentially. Activating freeze wells sequentially may allow flowing water to more easily flow around portions of a barrier formed by freeze wells activated first. Allowing water to initially flow through portions of a barrier as the barrier forms may alleviate pressure exerted by the flowing water upon the forming barrier, thereby increasing chances of successfully creating a structurally stable barrier. In some embodiments, refrigerant may be circulated through the freeze wells after circulating water through the freeze well for a period of time. FIG. 3 depicts a schematic representation of double barrier containment system 200. Treatment area 202 may be surrounded by double barrier containment system 200 formed by sequential activation of freeze wells 216. Freeze wells 216A may be activated first to form a first portion of second barrier 206. Upon formation of the first portion of second barrier 206, freeze wells 216B may be activated. Freeze wells 216B, when activated, form a second portion of second barrier 206. Upon formation of the second portion of second barrier 206, freeze wells 216C may be activated. Freeze wells 216C, when activated, form a third portion of the second barrier. Sequential activation of freeze wells 216A-C may continue until second barrier 206 is formed. In some embodiments, after formation of second barrier 206, first barrier 204 are formed. Formation of first barrier 204 may not require sequential activation to form due to the protection provided by second barrier 206.

In some embodiments, controlling the pressure within the treatment area of the hydrocarbon containing formation assists in successfully creating a structurally stable barrier. Pressure in the treatment area may be increased or decreased relative to outside of the treatment area in order to affect the flow of fluids between the interior and exterior of the treatment area. There are of course a number of ways of increasing/decreasing the pressure inside the treatment area known to one skilled in the art (for example, using injection/productions wells in the treatment area). There are many advantages to controlling the pressure in the treatment area as regards to forming and/or repairing barriers surrounding at least a portion of the treatment area. When a barrier formed by freeze wells is near completion the interior pressure of the treatment area may be changed to equilibrate the interior pressure and the exterior pressure of the treatment area. Equilibrating the pressure may substantially reduce or eliminate the flow of fluids between the exterior and the interior of the treatment area through any openings in the barrier. Equilibrating the pressure may reduce the pressure on the barrier itself. Reducing or eliminating the flow of fluids between the exterior and the interior of the treatment area through any openings in the barrier may facilitate the final formation of the barrier hindered by the flow of fluid through openings in the barrier.

In some embodiments, one or more horizontal freeze wells are employed to temporarily divert water flowing through a formation. Diverting water flow at least temporarily while a barrier is being formed may expedite formation of the barrier. Horizontals well (for example, a well positioned at a 45 degree angle to the flow of the subsurface water) may be used to form an underground channel or culvert to divert water at least temporarily while one or more vertical barriers around a treatment area are formed. Final closure of the wall may be accomplished by setting a mechanical barrier in the horizontal well (for example, installing a bridge plug or packer) or installing freezing equipment in the well and freezing water inside the well. Using a well that is positioned at an angle to the flow of the subsurface water allows the subsurface water to remain in the formation sections having a lower temperature for a longer period of time. Thus, barrier formation may be accelerated as compared to using vertical wells. In some embodiments, the barrier is extended such that the water flow or other fluids (for example, carbon dioxide that is sequestered in the treatment area) are inhibited from entering the substantially horizontal channel and the treatment area.

In addition to needing to resist pressure and forces exerted by subsurface water flows, barriers need to resist pressures and forces exerted by geomechanical motion. When the formation is heated, the heat input into the formation may cause expansion of the formation and geomechanical motion. Geomechanical motion may include geomechanical shifting, shearing, and/or expansion stress in the formation. Changing a shape of a perimeter of the barrier may reduce the pressures exerted by such forces as geomechanical motion. Extra forces may be exerted on one or more of the edges of a barrier. In some embodiments, a barrier has a perimeter which forms a corrugated surface on the barrier. A corrugated barrier may be more resistant to geomechanical motion. In some embodiments, a barrier extends down vertically in a formation and continues underneath a formation. Extending a barrier (for example, a barrier formed by freeze wells) down and underneath a formation may be more resistant to geomechanical motion.

The pressure difference between the water flow in the formation and one or more portions of a barrier (for example, a frozen barrier formed by freeze wells) may be referred to as disjoining pressure. Disjoining pressure may inhibit the formation of a barrier. The formation may be analyzed to assess the most appropriate places to position barriers. To overcome the problems caused by disjoining pressure on the formation of barriers, barriers may be formed rapidly. In some embodiments, super cooled fluids (for example, liquid nitrogen) is used to rapidly freeze water to form the barrier.

Figure 4:
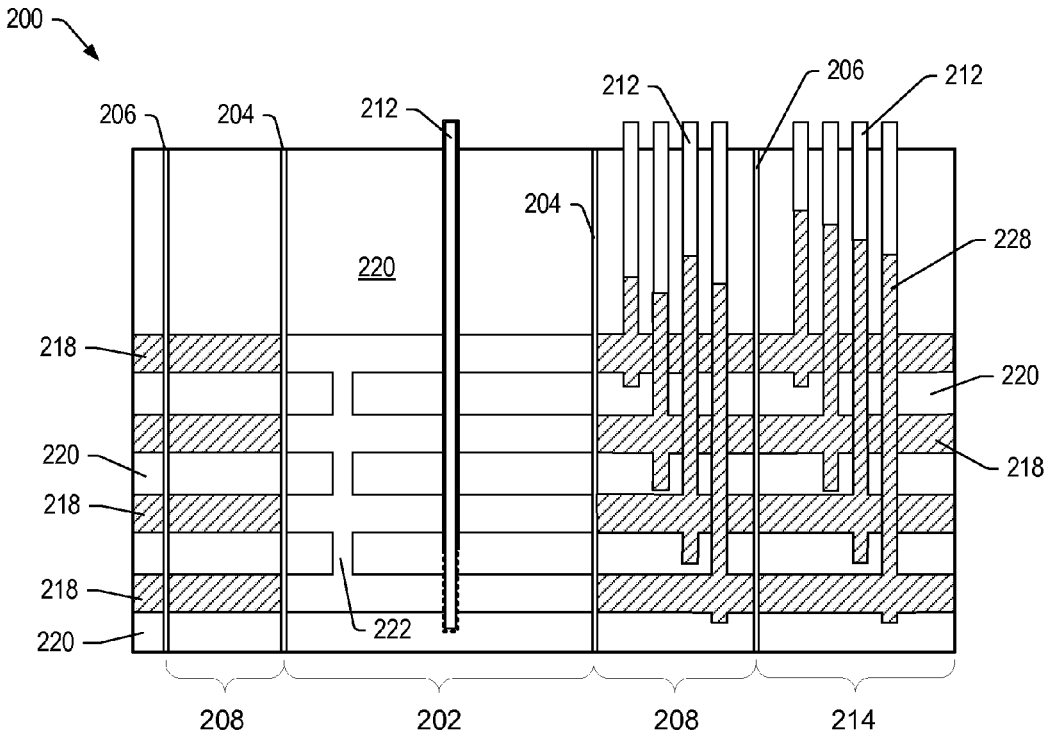
FIG. 4 depicts a cross-sectional view of an embodiment of a dual barrier system used to isolate a treatment area in a formation.

FIG. 4 depicts a cross-sectional view of double barrier system 200 used to isolate treatment area 202 in the formation. The formation may include one or more fluid bearing zones 218 and one or more impermeable zones 220. First barrier 204 may at least partially surround treatment area 202. Second barrier 206 may at least partially surround first barrier 204. In some embodiments, impermeable zones 220 are located above and/or below treatment area 202. Thus, treatment area 202 is sealed around the sides and from the top and bottom. In some embodiments, one or more paths 222 are formed to allow communication between two or more fluid bearing zones 218 in treatment area 202. Fluid in treatment area 202 may be pumped from the zone. Fluid in inter-barrier zone 208 and fluid in outer zone 214 is inhibited from reaching the treatment area. During in situ conversion of hydrocarbons in treatment area 202, formation fluid generated in the treatment area is inhibited from passing into inter-barrier zone 208 and outer zone 214.

After sealing treatment area 202, fluid levels in a given fluid bearing zone 218 may be changed so that the fluid head in inter-barrier zone 208 and the fluid head in outer zone 214 are different. The amount of fluid and/or the pressure of the fluid in individual fluid bearing zones 218 may be adjusted after first barrier 204 and second barrier 206 are formed. The ability to maintain different amounts of fluid and/or pressure in fluid bearing zones 218 may indicate the formation and completeness of first barrier 204 and second barrier 206. Having different fluid head levels in treatment area 202, in fluid bearing zones 218, in inter-barrier zone 208, and in the fluid bearing zones in outer zone 214 allows for determination of the occurrence of a breach in first barrier 204 and/or second barrier 206. In some embodiments, the differential pressure across first barrier 204 and second barrier 206 is adjusted to reduce stresses applied to first barrier 204 and/or second barrier 206, or stresses on certain strata of the formation.

Subsurface formations include dielectric media. Dielectric media may exhibit conductivity, relative dielectric constant, and loss tangents at temperatures below 100° C. Loss of conductivity, relative dielectric constant, and dissipation factor may occur as the formation is heated to temperatures above 100° C. due to the loss of moisture contained in the interstitial spaces in the rock matrix of the formation. To prevent loss of moisture, formations may be heated at temperatures and pressures that minimize vaporization of water. Conductive solutions may be added to the formation to help maintain the electrical properties of the formation.

In some embodiments, the relative dielectric constant and/or the electrical resistance is measured on the inside and outside of freeze wells. Monitoring the dielectric constant and/or the electrical resistance may be used to monitor one or more freeze wells. A decrease in the voltage difference between the interior and the exterior of the well may indicate a leak has formed in the barrier.

Some fluid bearing zones 218 may contain native fluid that is difficult to freeze because of a high salt content or compounds that reduce the freezing point of the fluid. If first barrier 204 and/or second barrier 206 are low temperature zones established by freeze wells, the native fluid that is difficult to freeze may be removed from fluid bearing zones 218 in inter-barrier zone 208 through pumping/monitor wells 212. The native fluid is replaced with a fluid that the freeze wells are able to more easily freeze.

In some embodiments, pumping/monitor wells 212 are positioned in treatment area 202, inter-barrier zone 208, and/or outer zone 214. Pumping/monitor wells 212 may be used to test for freeze completion of frozen barriers and/or for pressure testing frozen barriers and/or strata. Pumping/monitor wells 212 may be used to remove fluid and/or to monitor fluid levels in treatment area 202, inter-barrier zone 208, and/or outer zone 214. Using pumping/monitor wells 212 to monitor fluid levels in contained zone 202, inter-barrier zone 208, and/or outer zone 214 may allow detection of a breach in first barrier 204 and/or second barrier 206. Pumping/monitor wells 212 allow pressure in treatment area 202, each fluid bearing zone 218 in inter-barrier zone 208, and each fluid bearing zone in outer zone 214 to be independently monitored so that the occurrence and/or the location of a breach in first barrier 204 and/or second barrier 206 can be determined.

In some embodiments, fluid pressure in inter-barrier zone 208 is maintained greater than the fluid pressure in treatment area 202, and less than the fluid pressure in outer zone 214. If a breach of first barrier 204 occurs, fluid from inter-barrier zone 208 flows into treatment area 202, resulting in a detectable fluid level drop in the inter-barrier zone. If a breach of second barrier 206 occurs, fluid from the outer zone flows into inter-barrier zone 208, resulting in a detectable fluid level rise in the inter-barrier zone.

Figure 5:
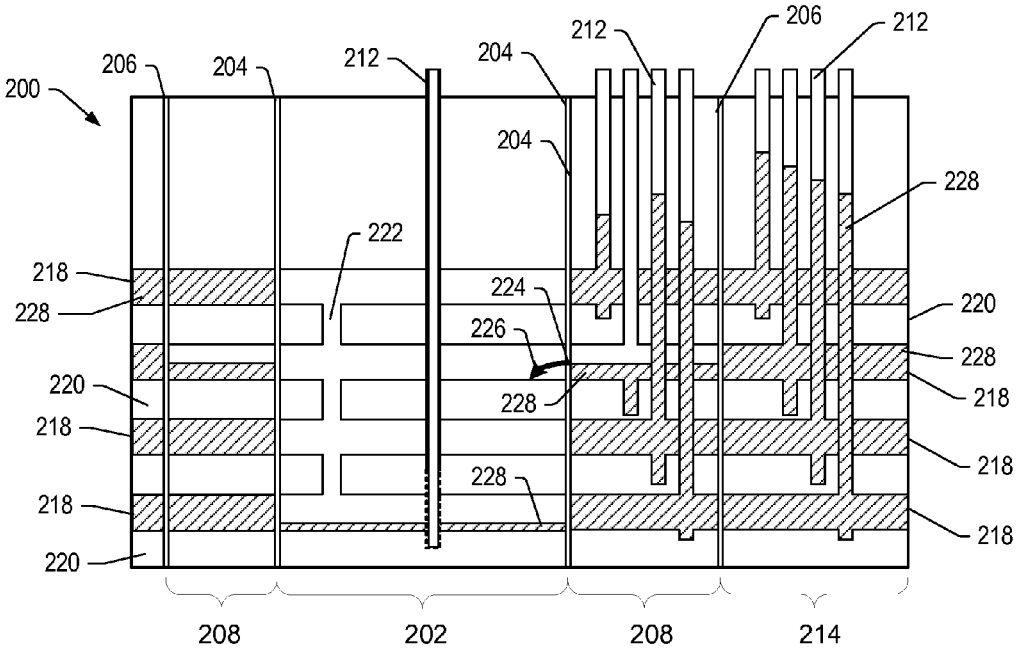
FIG. 5 depicts a cross-sectional view of an embodiment of a breach in a first barrier of dual barrier system.

A breach of first barrier 204 may allow fluid from inter-barrier zone 208 to enter treatment area 202. FIG. 5 depicts breach 224 in first barrier 204 of double barrier containment system 200. Arrow 226 indicates flow direction of fluid 228 from inter-barrier zone 208 to treatment area 202 through breach 224. The fluid level in fluid bearing zone 218 proximate breach 224 of inter-barrier zone 208 falls to the height of the breach. Path 222 allows fluid 228 to flow from breach 224 to the bottom of treatment area 202, increasing the fluid level in the bottom of the contained zone. The volume of fluid that flows into treatment area 202 from inter-barrier zone 208 is typically small compared to the volume of the treatment area. The volume of fluid able to flow into treatment area 202 from inter-barrier zone 208 is limited because second barrier 206 inhibits recharge of fluid 228 into the affected fluid bearing zone. In some embodiments, the fluid that enters treatment area 202 is pumped from the treatment area using pumping/monitor wells 212 in the treatment area. In some embodiments, the fluid that enters treatment area 202 may be evaporated by heaters in the treatment area that are part of the in situ conversion process system. The recovery time for the heated portion of treatment area 202 from cooling caused by the introduction of fluid from inter-barrier zone 208 may be brief. For example, the recovery time may be less than a month, less than a week, or less than a day.

Pumping/monitor wells 212 in inter-barrier zone 208 may allow assessment of the location of breach 224. When breach 224 initially forms, fluid flowing into treatment area 202 from fluid bearing zone 218 proximate the breach creates a cone of depression in the fluid level of the affected fluid bearing zone in inter-barrier zone 208. Time analysis of fluid level data from pumping/monitor wells 212 in the same fluid bearing zone as breach 224 can be used to determine the general location of the breach.

When breach 224 of first barrier 204 is detected, pumping/monitor wells 212 located in the fluid bearing zone that allows fluid to flow into treatment area 202 may be activated to pump fluid out of the inter-barrier zone. Pumping the fluid out of the inter-barrier zone reduces the amount of fluid 228 that can pass through breach 224 into treatment area 202.

Breach 224 may be caused by ground shift. If first barrier 204 is a low temperature zone formed by freeze wells, the temperature of the formation at breach 224 in the first barrier is below the freezing point of fluid 228 in inter-barrier zone 208. Passage of fluid 228 from inter-barrier zone 208 through breach 224 may result in freezing of the fluid in the breach and self-repair of first barrier 204.

Figure 6:
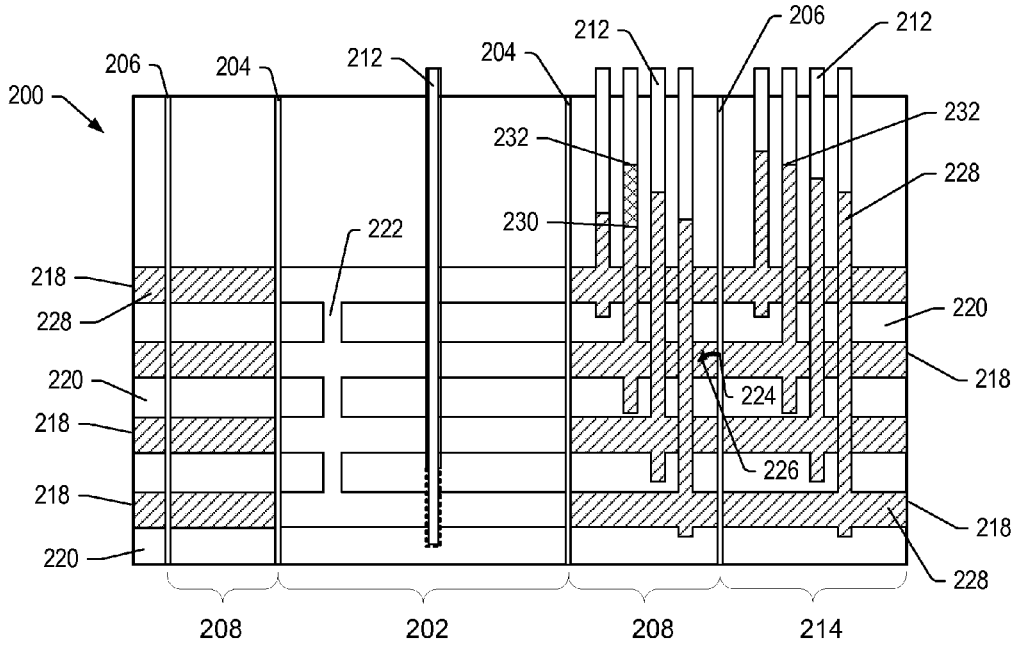
FIG. 6 depicts a cross-sectional view of an embodiment of a breach in a second barrier of dual barrier system.

A breach of the second barrier may allow fluid in the outer zone to enter the inter-barrier zone. The first barrier may inhibit fluid entering the inter-barrier zone from reaching the treatment area. FIG. 6 depicts breach 224 in second barrier 206 of double barrier system 200. Arrow 226 indicates flow direction of fluid 228 from outside of second barrier 206 to inter-barrier zone 208 through breach 224. As fluid 228 flows through breach 224 in second barrier 206, the fluid level in the portion of inter-barrier zone 208 proximate the breach rises from initial level 230 to a level that is equal to level 232 of fluid in the same fluid bearing zone in outer zone 214. An increase of fluid 228 in fluid bearing zone 218 may be detected by pumping/monitor well 212 positioned in the fluid bearing zone proximate breach 224 (for example, a rise of fluid from initial level 230 to level 232 in the pumping monitor well in inter-barrier zone 208).

Breach 224 may be caused by ground shift. If second barrier 206 is a low temperature zone formed by freeze wells, the temperature of the formation at breach 224 in the second barrier is below the freezing point of fluid 228 entering from outer zone 214. Fluid from outer zone 214 in breach 224 may freeze and self-repair second barrier 206.

First barrier and second barrier of the double barrier containment system may be formed by freeze wells. In certain embodiments, the first barrier is formed before the second barrier. The cooling load needed to maintain the first barrier may be significantly less than the cooling load needed to form the first barrier. After formation of the first barrier, the excess cooling capacity that the refrigeration system used to form the first barrier may be used to form a portion of the second barrier. In some embodiments, the second barrier is formed first and the excess cooling capacity that the refrigeration system used to form the second barrier is used to form a portion of the first barrier. After the first and second barriers are formed, excess cooling capacity supplied by the refrigeration system or refrigeration systems used to form the first barrier and the second barrier may be used to form a barrier or barriers around the next contained zone that is to be processed by the in situ conversion process.

In some embodiments, a low temperature barrier formed by freeze wells surrounds all or a portion of the treatment area. As the fluid introduced into the formation approaches the low temperature barrier, the temperature of the formation becomes colder. The colder temperature increases the viscosity of the fluid, enhances precipitation, and/or solidifies the fluid to form the barrier that inhibits flow of formation fluid into or out of the formation. The fluid may remain in the formation as a highly viscous fluid or a solid after the low temperature barrier has dissipated.

In certain embodiments, saturated saline solution is introduced into the formation. Components in the saturated saline solution may precipitate out of solution when the solution reaches a colder temperature. The solidified particles may form the barrier to the flow of formation fluid into or out of the formation. The solidified components may be substantially insoluble in formation fluid.

In certain embodiments, brine is introduced into the formation as a reactant. A second reactant, such as carbon dioxide, may be introduced into the formation to react with the brine. The reaction may generate a mineral complex that grows in the formation. The mineral complex may be substantially insoluble to formation fluid. In an embodiment, the brine solution includes a sodium and aluminum solution. The second reactant introduced in the formation is carbon dioxide. The carbon dioxide reacts with the brine solution to produce dawsonite. The minerals may solidify and form the barrier to the flow of formation fluid into or out of the formation.

In certain embodiments, a bitumen barrier may be formed in the formation in situ. Formation of a bitumen barrier may reduce energy costs in formations that contain water. For example, a formation includes water proximate an outside perimeter of an area of the formation to be treated. Thirty percent of the energy needed for heating the treatment area may be used to heat or evaporate water outside the perimeter. The evaporated water may condense in undesirable regions. Formation of a bitumen barrier will inhibit heating of fluids outside the perimeter of the treatment area, thus thirty percent more energy is available to heat the treatment area as compared to the energy necessary to heat the treatment area when a bitumen barrier is not present.

Formation of a bitumen barrier in situ may include heating an outer portion of a treatment area to a selected temperature range (for example, between about 80° C. and about 110° C. or between 90° C. and 100° C.) to mobilize bitumen using one or more heaters. Over the selected temperature range, a sufficient viscosity of the bitumen is maintained to allow the bitumen to move away from the heater wellbores. In certain embodiments, heaters in the heater wellbores are temperature limited heaters with temperatures near the mobilization temperature of bitumen such that the temperature near the heaters stays relatively constant and above temperatures resulting in the formation of solid bitumen. In some embodiments, the region adjacent to the wellbores used to mobilize bitumen may be heated to a temperature above the mobilization temperature, but below the pyrolysis temperature of hydrocarbons in the formation for a period of time. In certain embodiments, the formation is heated to temperatures above the mobilization temperature, but below the pyrolysis temperature of hydrocarbon in the formation for about six months. After the period of time, the heaters may be turned off and the temperature in the wellbores may be monitored (for example, using a fiber optic temperature monitoring system).

In some embodiments, a temperature of bitumen in a portion of the formation between two adjacent heaters is influenced by both heaters. In some embodiments, the portion of the formation that is heated is between an existing barrier (for example, a barrier formed using a freeze well) and the heaters on the outer portion of the formation.

In some embodiments, the heater wellbores used to heat bitumen are dedicated heater wellbores. One or more heater wellbores may be located at an edge of an area to be treated using the in situ heat treatment process. Heater wellbores may be located a selected distance from the edge of the treatment area. For example, a distance of a heater wellbore from the edge of the treatment area may range from about 20 m to about 40 m or from about 25 m to about 35 m. Heater wellbores may be about 1 m to about 2 m above or below a layer containing water. In some embodiments, a dedicated heater wellbore is used to mobilize bitumen to form a barrier.

In some embodiments, an oxidizing compound is injected in the bitumen to heat the formation and mobilize the bitumen. The oxidizing compound may interact with water and/or hydrocarbons in the hydrocarbon layer to cause a sufficient rise in temperature (for example, to temperatures ranging from 100° C. to 250° C., from 120° C. to 240° C., or from 150° C. to 230° C.) such that the bitumen is mobilized in the hydrocarbon formation. Oxidizing compounds include, but are not limited to, ammonium and sodium persulfate, ammonium nitrates, potassium nitrates, sodium nitrates, perborates, oxides of chlorine (for example, perchlorates and/or chlorine dioxide), permanganates, hydrogen peroxide (for example, an aqueous solution of about 30% to about 50% hydrogen peroxide), hot air, or mixtures thereof.

As the mobilized bitumen enters cooler portions of the formation (for example, portions of the formation that have a temperature below the mobilization temperature of the bitumen), the bitumen may solidify and form a barrier to other fluid flowing in the formation. In some embodiments, the mobilized bitumen is allowed to flow and diffuse into the formation from the wellbores. In some embodiments, pressure in the section containing bitumen is adjusted or maintained (for example, at about 1 MPa) to control direction and/or velocity of the bitumen flow. In some embodiments, the bitumen gravity drains into a portion of the formation.

In some embodiments, the bitumen enters portions of the formation containing water cooler than the average temperature of the mobilized bitumen. The water may be in a portion of the formation below or substantially below the heated portion containing bitumen. In some embodiments, the water is in a portion of the formation that is between at least two heaters. The water may be cooled, partially frozen, and/or frozen using one or more freeze wells. In some embodiments, pressure in the section containing water is adjusted or maintained (for example, at about 1 MPa) to move water in the section towards the mobilized bitumen. In some embodiments, the bitumen gravity drains to a portion of the formation containing the cool water.

In some embodiments, the portion of the formation containing water is assessed to determine the amount of water saturation in the water bearing portion. Based on the assessed water saturation in the water bearing portion, a selected number of wells and spacing of the selected wells may be determined to ensure that sufficient bitumen is mobilized to form a barrier of a desired thickness. For example, sufficient wells and spacing may be determined to create a barrier having a thickness of 10 m.

Portions of the mobilized bitumen may partially solidify and/or substantially solidify as the bitumen flows into the cooler portion of the formation. In some embodiments, the cooler portion of the formation may include cool water and/or bitumen/water mixture (for example, a portion of the formation cooled using freeze wells or containing frozen water).

Heating of selected portions of the formation may be stopped, and the portions of the formation may be allowed to naturally cool such that the bitumen and/or bitumen/water mixture in the formation solidifies. Location of the bitumen barrier may be determined using pressure tests. The integrity of the formed barrier may be tested using pulse tests and/or tracer tests.

In some embodiments, one or more compounds are injected into the bitumen, water and/or bitumen/water mixture. The compounds may react with and/or solvate the bitumen to lower the viscosity. In some embodiments, the compounds react with the water, bitumen, or other hydrocarbons in the mixture to enhance solidification of the bitumen. Reaction of the compounds with the water, bitumen and/or other hydrocarbons may generate heat. The generated heat may be sufficient to initially lower the viscosity of the bitumen such that the bitumen flows into fractures and/or vugs in the formation. The bitumen may cool and solidify in the fractures and/or vugs to form additional bitumen barriers.

In some embodiments, one or more oxidizing compounds (for example, oxygen or an oxygenated gas) are injected proximate mobilized bitumen. The rate and amount of oxidizing compound may be controlled so that at least a portion of the bitumen undergoes low temperature oxidation (for example, a temperature of less than 200° C.) to form sufficient oxidized hydrocarbons on the surface of the bitumen or in inner portions of the bitumen barrier. In some embodiments, the oxygenated hydrocarbons are formed during injection of oxidizing compounds to generate heat in the formation. The oxygenated hydrocarbons may form higher molecular weight compounds and/or a polymeric matrix in the bitumen. As the bitumen cools, the oxygenated hydrocarbons may seal the bitumen, thus forming a substantially impermeable barrier.

In some embodiments, after the bitumen barrier is formed, a portion of the outside surface of the bitumen barrier is sealed. In some embodiments, a portion of an inner surface and/or an outside surface of the bitumen barrier is sealed. The bitumen barrier may be sealed in situ (for example, by forming oxygenated hydrocarbons in situ) and/or one or more sealing compounds may be introduced proximate the bitumen barrier.

In some embodiments, sealing compounds are introduced proximate the bitumen barrier. The sealing compounds may adhere to and/or react with the bitumen barrier, thereby generating a sealant layer (for example, a crust) or generate one or more layers in the bitumen to seal the bitumen and form a bitumen barrier. In some embodiments, reaction of the bitumen with the sealing compounds or injection of the sealing compounds into the bitumen generates a polymeric network or crosslinking of compounds in the bitumen to form a substantially impermeable barrier. Sealing of the bitumen may inhibit the bitumen barrier from collapsing when a temperature of the treatment area inside the bitumen barrier increases above the mobilization temperature of the bitumen. Formation of a sealant layer may inhibit water penetration of the barrier and/or the treatment area. Over a period of time, additional sealing compounds may be added to maintain the performance and/or sealant layer of the bitumen barrier.

Distribution of the sealing compounds to the surface or interior portion of the bitumen barrier may be facilitated by providing (for example, injecting) the sealing compounds into fractures in the formation, control of pressure gradients and/or flow rates of the sealing compounds. Amounts of the compounds may be adjusted to control a temperature of the reaction between the sealing compounds with the bitumen, water and/or hydrocarbons in the formation and/or to control the thickness of the sealant layer. In some embodiments, sealing compounds are encapsulated (for example, microcapsules). The encapsulated sealing compounds may be introduced into the water phase that flows to the region of interest and are released at a specified time and/or temperature.

A sealant layer may be made of one or more sealing compounds. Sealing compounds may be any compound or material that has the ability to react with water, bitumen, hydrocarbons and/or mixtures thereof, the ability to couple to a surface of the barrier, and/or the ability to impede movement of bitumen. The sealing compounds exhibit chemical stability at or near the temperatures suitable for forming the barrier (for example, temperatures between about 80° C. and 120° C. or 90° C. and 110° C.). Examples of sealing compounds include, but are not limited to, particles, compounds capable of promoting adhesion, compounds capable of promoting, and/or undergoing a polymerization reaction, or mixtures thereof.

Particles may be inorganic compounds, polymers, functionalized polymers capable of coupling to one or more compounds in the bitumen layer, or mixtures thereof. The particles may be sized for optimal delivery to the bitumen barrier. For example, the particles may be nanoparticles and/or have a bimodal particle size distribution. In some embodiments, particles include one or more compounds from Columns 8-14 of the Periodic Table. Particles may include metals and/or metal oxides. Examples of particles include, but are not limited to, iron, iron oxide, silicon, and silicon oxides. In some embodiments, functionalized particles react with the compounds in the bitumen layer and/or compounds on the surface of the bitumen layer to form cross-linked polymers. Cross-linking of the particles to form the sealant layer may increase flexibility and strength of the barrier.

In some embodiments, compounds that promote adhesion of materials to hydrocarbons assist in bonding inorganic compounds or particles to a portion of the bitumen barrier. Adhesion promoters include, but are not limited to, silanes that have one or more groups that may be reacted with a hydrocarbon and/or maleic anhydride derivatives. Silanes include, but are not limited to, silanes containing nitrogen, sulfur, epoxides, terminal olefins, halogens, or combinations thereof. Examples of adhesion promoters include, but are not limited to, organosilanes, alkoxysilanes, substituted alkoxysilanes, phosphonates, sulfonates, amines derived from fatty acids, diamines, polyols, or mixtures thereof.

Sealing compounds capable of promoting or undergoing a polymerization reaction may include monomers or homopolymers that may be cross-linked in-situ to form a polymeric substance. Such sealing compounds include, but are not limited to, azo compounds, vulcanizing agents (for example, sulfur), acrylates, or mixtures thereof. In some embodiments, particles are cross-linked to the bitumen barrier to form a sealant layer. Cross-linking agents include, but are not limited to, dimethacrylates, divinylethers, substituted silanes, and bidentate ligands.

In some embodiments, more than one sealing compound is used to form the sealant layer of the bitumen barrier. The sealing compounds may be layered and/or reacted to form multiple layers. Formation of multiple layers in the sealant layer may strengthen and/or inhibit penetration of fluids into the barrier during use. In some embodiments, after a portion of the bitumen barrier is partially formed or, in certain embodiments, substantially formed, a first sealing compound is injected into the formation through an injection well in the treatment area proximate the bitumen barrier. The injection well may be positioned to efficiently provide delivery of the barrier materials. The first sealing compound may contact the bitumen barrier to form a first sealant layer. After a portion of the first sealant layer is partially formed or, in certain embodiments, substantially formed, a second sealing compound may be injected into the formation through the injection well. The second sealing compound may contact the first sealing compound and form a second sealant layer. More sealing compounds may be injected sequentially to form a sealant layer that includes more than one layer (for example, 2, 3, 5, or 10 layers).

In some embodiments, the first sealant compound couples (for example, adheres or polymerizes with hydrocarbons in the bitumen barrier) to the bitumen barrier and includes functional groups (for example, amino groups) that react with the second sealing compound to form the sealant layer on the outer surface of the bitumen barrier between the treatment area and the bitumen barrier. In some embodiments, the first and/or second sealing compounds include particles that may be coupled to or imbedded in the bitumen layer.

In some embodiments, the first sealant compound couples to the bitumen barrier and the second sealant compound reacts with the first sealant compound to form a cross-linked polymer layer on the outer surface of the bitumen barrier proximate the treatment area. In some embodiments, the first and/or second sealing compounds include particles that are coupled to or imbedded in the bitumen layer.

In some embodiments, the first sealant compound that promotes adhesion couples to the bitumen barrier and the second sealing compound attaches to the adhesion promoting agents coupled to the bitumen barrier. The first sealing compound and/or second sealing compound may include functionalization that allows a third sealing compound to be attached to first and/or second sealing compounds. A third sealing compound may be contacted with the first and/or second sealing compounds to form an adherent sealing layer. In some embodiments, the first, second, and/or third sealing compounds include particles that are coupled to or imbedded in the bitumen layer.

After the bitumen barrier and/or a bitumen barrier containing a sealant layer are formed, the area inside the bitumen barrier may be treated using an in situ process. The treatment area may be heated using heaters in the treatment area. Temperature in the treatment area is controlled such that the bitumen barrier is not compromised. In some embodiments, after the bitumen barrier is formed, heaters near the bitumen barrier are exchanged with freeze canisters and used as freeze wells to form additional freeze barriers. Mobilized and/or visbroken hydrocarbons may be produced from production wells in the treatment area during the in situ heat treatment process. In some embodiments, after treating the section, carbon dioxide produced from other in situ heat treatment processes may be sequestered in the treated area.

Figure 7A:
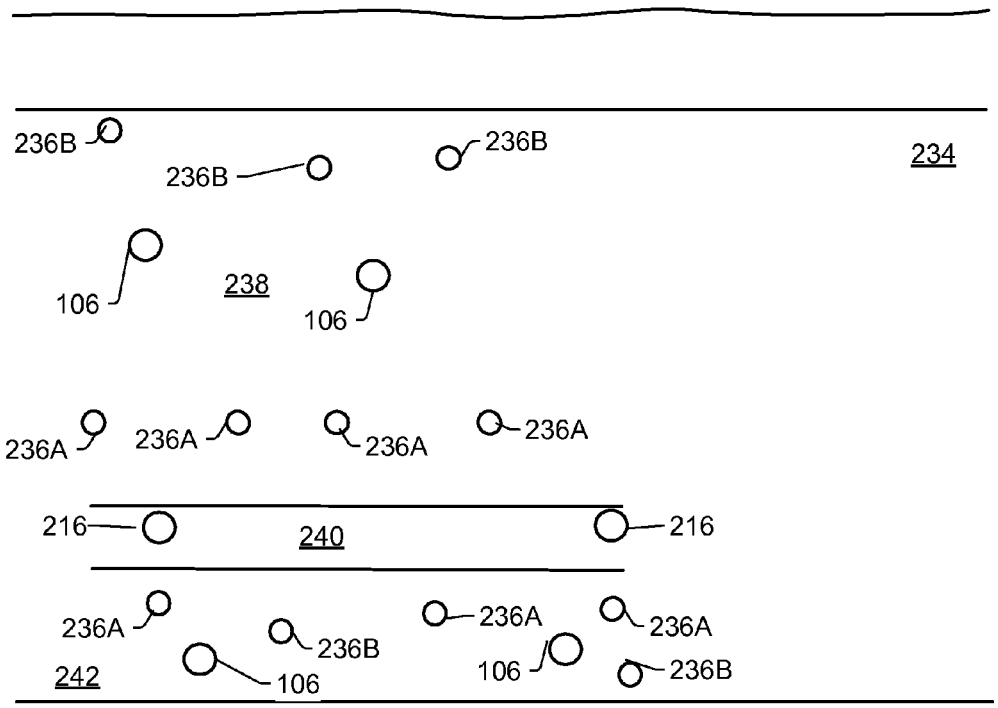
FIGS. 7A and 7B depict a schematic representation of embodiments of forming a bitumen barrier in a subsurface formation.
Figure 7B:
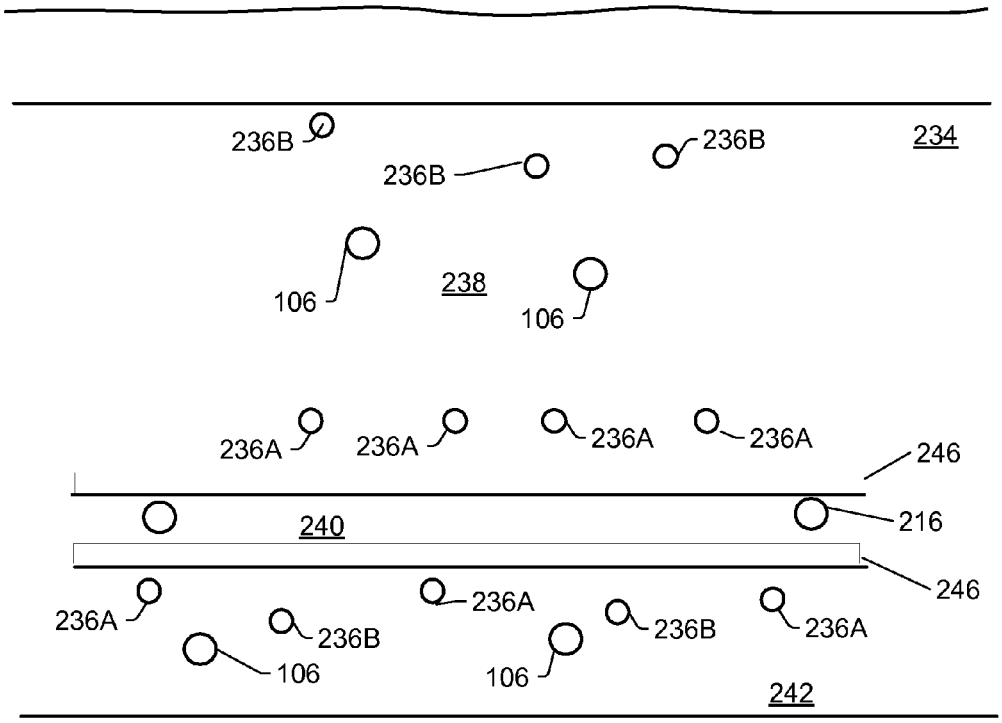
Figure 8:
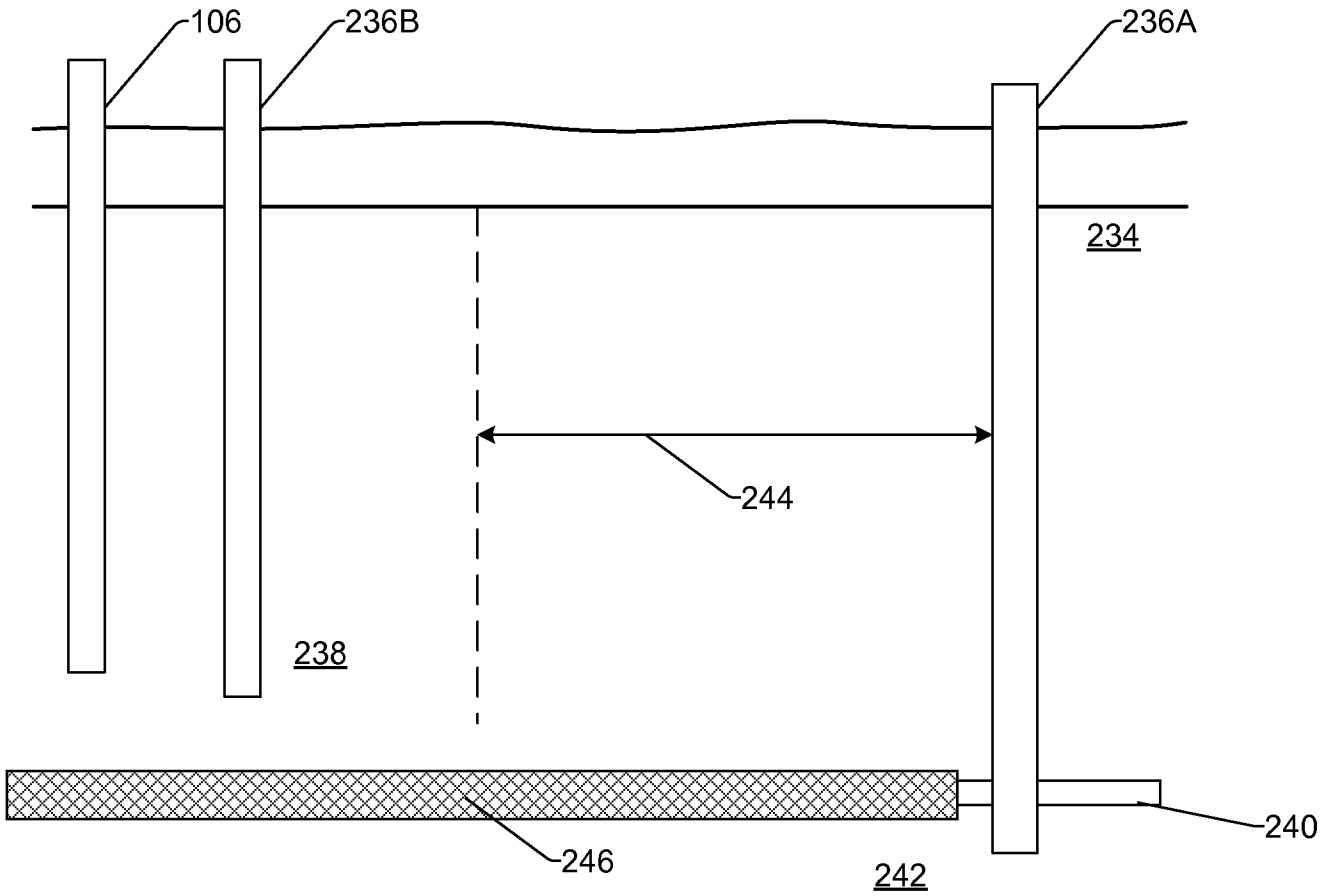
FIG. 8 depicts a schematic representation of another embodiment of forming a bitumen barrier in a subsurface formation.
Figure 9:
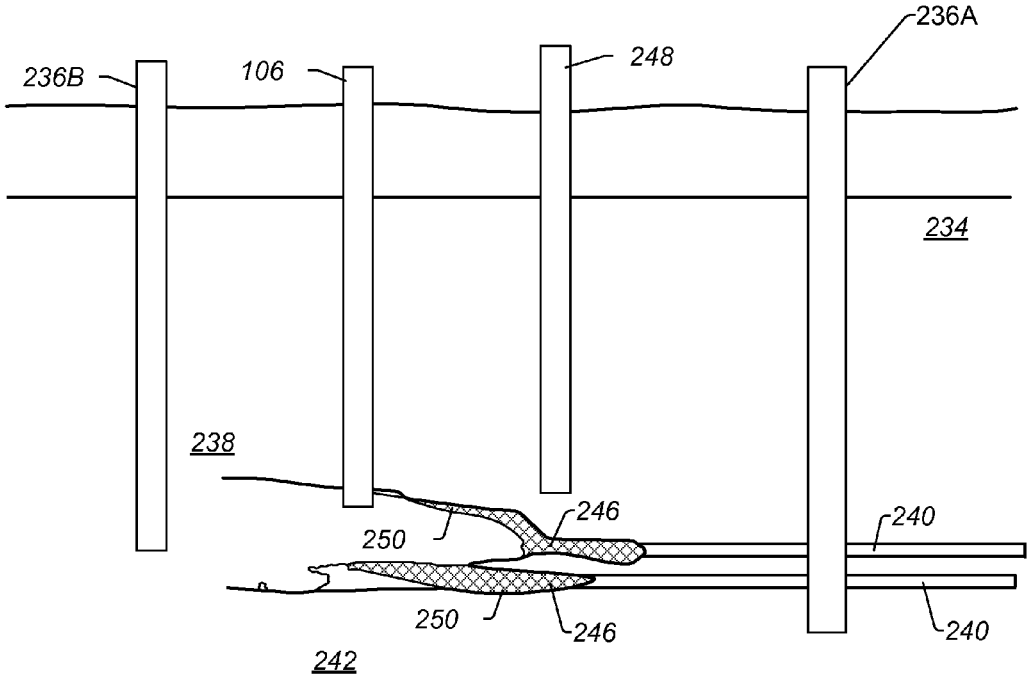
FIG. 9 depicts a schematic representation of an embodiment of forming a sealant layer on a bitumen barrier in a subsurface formation.

FIGS. 7A, 7B, and 8 depict schematic representations of embodiments of forming a bitumen barrier in a subsurface formation. FIG. 9 depicts a schematic representation of an embodiment of forming a sealant layer on a bitumen barrier in a subsurface formation. Heaters 236A in treatment area 238 and/or treatment area 242 in hydrocarbon layer 234 may provide a selected amount of heat to the formation sufficient to mobilize bitumen near heaters 236A. As shown in FIG. 8, heater 236A is located a selected distance 244 from treatment area 238. Mobilized bitumen may move away from heaters 236A and/or drain towards section 240 in the formation. As shown in FIGS. 7A and 7B, section 240 is between section 238 and section 242. It should be understood, however, that section 240 may be adjacent to or surround section 238 and/or section 242. At least a portion of section 240 contains water. As shown in FIG. 8, section 240 may be a fractured layer below section 238. Water in section 240 may be cooled using freeze wells 216 (shown in FIGS. 7A and 7B). Adjusting and/or maintaining a pressure in freeze wells 216 may move water in section 240 towards section 238 and/or section 242.

As the bitumen enters section 240 and contacts water in the section, the bitumen/water mixture may solidify along the perimeter of section 240 or in the section to form bitumen barrier 246, shown in FIG. 7B and FIG. 8. Formation of bitumen barrier 246 may inhibit fluid from flowing in or out of section 238 and/or section 242. For example, water may be inhibited from flowing out of section 240 into section 238 and/or section 242.

After, or in some embodiments during, formation of bitumen barrier 246, one or more compounds and/or one or more materials may be injected proximate the bitumen barrier using injection well 248. In some embodiments, an oxidizing fluid is injected using injection well 248 proximate the barrier and a portion of the bitumen barrier is oxidized to form a sealant layer. As shown in FIG. 9, the compounds and/or materials may flow through the formation and react with and/or adhere to bitumen barrier 246 to form sealant layer 250 and/or reinforce the bitumen barrier. Sealant layer 250 may include one or more layers formed by one or more compounds and/or materials that adhere and/or react with hydrocarbons or water in bitumen barrier 246.

After formation of the bitumen barrier, heat from heaters 236A and/or 236B may heat section 238 and/or section 242 to mobilize hydrocarbons in the sections towards production wells 106. Mobilized hydrocarbons may be produced from production wells 106. In some embodiments, mobilized hydrocarbons from section 238 and/or section 242 are produced from other portions of the formation. In some embodiments, at least some of heaters 236A are converted to freeze wells to form additional barriers in hydrocarbon layer 234.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a layer" includes a combination of two or more layers and reference to "a fluid" includes mixtures of fluids.

In this patent, certain U.S. patents and U.S. patent applications have been incorporated by reference. The text of such U.S. patents and U.S. patent applications is, however, only incorporated by reference to the extent that no conflict exists between such text and the other statements and drawings set forth herein. In the event of such conflict, then any such conflicting text in such incorporated by reference U.S. patents and U.S. patent applications is specifically not incorporated by reference in this patent.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A method of forming a barrier in a formation, comprising:

heating a first portion of a formation adjacent to a plurality of wellbores to raise a temperature of the first portion adjacent to the wellbores above a mobilization temperature of bitumen in the first portion and below a pyrolysis temperature of hydrocarbons in the formation, thereby generating a mobilized heated bitumen; and allowing a portion of the mobilized heated bitumen to move outwards from the wellbores towards a second portion of the formation, the second portion of the formation comprising water cooler than the mobilization temperature of the bitumen; and mobilizing the cooler water in the second portion towards the mobilized heated bitumen such that the mobilized heated bitumen solidifies in the second portion of the formation to form a barrier.

2. The method of claim 1, wherein the barrier comprises some of the solidified bitumen and water.

3. The method of claim 1, wherein at least one heater used to heat the first portion of the formation adjacent the wellbores comprises a temperature limited heater.

4. The method of claim 1, wherein the second portion of the formation comprising water is substantially below the first portion of a formation adjacent to a plurality of wellbores.

5. The method of claim 1, further comprising contacting the mobilized heated bitumen with the cool water in the formation to form the barrier.

6. The method of claim 1, further comprising heating a portion of a treatment area inside the barrier with one or more heat sources to raise a temperature of a portion of the treatment area to mobilize at least some formation fluids in the treatment area.

7. The method of claim 1, further comprising storing carbon dioxide inside the barrier.

8. The method of claim 1, further comprising forming the barrier between an existing barrier and a treatment area for producing formation fluid from the formation.

9. The method of claim 1, wherein a temperature of the formation adjacent to the wellbores ranges from about 80° C. to about 150° C.

10. The method of claim 1, further comprising inhibiting production of at least a portion of hydrocarbon gases from the heated portion.

11. A method of forming a barrier in a formation, comprising:

assessing an amount of water in a first portion of a formation;

providing a selected number of heater wellbores based on the amount of water in the first portion of the formation to a second portion of the formation;

heating the second portion of the formation with the selected number of heater wellbores to raise a temperature of the formation adjacent to the wellbores above a mobilization temperature of bitumen in the second portion and below a pyrolysis temperature of hydrocarbons in the formation, thereby generating a heated bitumen; and allowing a portion of the heated bitumen to move outwards from the wellbores towards the first portion of the formation, wherein the water in the first portion is cooler than the mobilization temperature of the bitumen so that the heated bitumen solidifies in the formation to form a barrier between the first portion and the second portion.

12. The method of claim 11, wherein the selected number of heater wellbores is one.

13. The method of claim 11, wherein the selected number of heater wellbores is at least 20 m from an edge of an area suitable for treatment and heating comprises providing heat from one or more heat sources in the selected number of heater wellbores to raise a temperature of a portion of the treatment area such that at least some formation fluids in the treatment area are mobilized.

14. A method of forming a barrier in a formation, comprising:

heating a first portion of a formation adjacent to a plurality of wellbores to raise a temperature of a portion of the formation adjacent to the wellbores above a mobilization temperature of bitumen in the first portion and below a pyrolysis temperature of hydrocarbons in the formation, thereby generating a heated bitumen;

allowing at least a portion of the heated bitumen from the first portion of the formation to move outwards from the wellbores towards a second portion of the formation, the second portion of the formation being cooler than the mobilization temperature of the bitumen so that the heated bitumen solidifies in the second portion of the formation to form a bitumen barrier; and sealing the solidified bitumen barrier.

15. The method of claim 14, wherein the bitumen barrier comprises bitumen and water.

16. The method of claim 14, wherein at least one heater used to heat the portion of the formation adjacent the wellbores comprises a temperature limited heater.

17. The method of claim 14, wherein sealing the solidified bitumen comprises contacting one or more compounds with a portion of the bitumen barrier, wherein at least one of the compounds reacts with hydrocarbons or water in the bitumen barrier.

18. The method of claim 14, wherein sealing comprises contacting one or more compounds with a portion of the bitumen barrier and the method further comprises providing at least one of the compounds during movement of the heated bitumen, wherein the compound is capable of enhancing flow of the heated bitumen.

19. The method of claim 14, wherein sealing comprises adhering one or more compounds to a portion of a surface of the bitumen barrier.

20. The method of claim 14, wherein sealing comprises coupling one or more compounds, coupling one or more particles, or coupling one or more compounds and one or more particles to a portion of the bitumen barrier.

21. The method of claim 14, wherein sealing comprises providing at least two layers to a portion of the bitumen barrier, wherein a first layer is made by contacting a first compound, one or more particles, or a combination thereof with the portion of the bitumen barrier and a second layer is made by coupling a second compound, one or more particles, or a combination thereof with the first compound.

22. The method of claim 14, wherein sealing comprises coupling particles to the portion of the bitumen barrier with an adhesive compound.

23. The method of claim 14, wherein sealing comprises oxidizing a portion of the bitumen barrier by providing an oxidizing compound proximate the bitumen barrier.

* * * * *